US010344449B2

(12) United States Patent
Wagner

(10) Patent No.: US 10,344,449 B2
(45) Date of Patent: Jul. 9, 2019

(54) LIFTING ARRANGEMENT FOR A CONSTRUCTION MACHINE

(71) Applicant: Guangxi LiuGong Machinery Co., Ltd., Liuzhou, Guangxi (CN)

(72) Inventor: Edward Wagner, Guangxi (CN)

(73) Assignee: Guangxi LiuGong Machinery Co., Ltd., Liuzhou Guangxi (CN)

( * ) Notice: Subject to any disclaimer, the term of this patent is extended or adjusted under 35 U.S.C. 154(b) by 682 days.

(21) Appl. No.: 14/695,340

(22) Filed: Apr. 24, 2015

(65) Prior Publication Data

US 2016/0222623 A1 Aug. 4, 2016

(30) Foreign Application Priority Data

Feb. 2, 2015 (WO) ..... PCT/CN2015/072096

(51) Int. Cl.

| | |
|---|---|
| ***E02F 3/38*** | (2006.01) |
| ***E02F 3/42*** | (2006.01) |
| ***E02F 3/34*** | (2006.01) |
| ***E02F 9/08*** | (2006.01) |
| ***E02F 3/342*** | (2006.01) |

(52) U.S. Cl.

CPC ..... *E02F 3/422* (2013.01); *E02F 3/34* (2013.01); *E02F 3/342* (2013.01); *E02F 3/38* (2013.01); *E02F 9/0841* (2013.01)

(58) Field of Classification Search

CPC ..... E02F 3/422; E02F 3/342; E02F 9/0841; E02F 3/38; E02F 3/34

See application file for complete search history.

(56) References Cited

U.S. PATENT DOCUMENTS

| | | | |
|---|---|---|---|
| 2,577,826 | A | 12/1951 | Adams |
| 2,980,271 | A | 4/1961 | Ulinski |
| 3,115,259 | A | 12/1963 | Wagner |

(Continued)

FOREIGN PATENT DOCUMENTS

| | | | |
|---|---|---|---|
| CN | 201050073 | Y | 4/2008 |
| CN | 102285327 | A * | 12/2011 |

(Continued)

OTHER PUBLICATIONS

Notification of Transmittal of the International Search Report dated Jul. 20, 2015, Written Opinion of the International Searching Authority, 12 pages.

(Continued)

*Primary Examiner* — Michael S Lowe

(74) *Attorney, Agent, or Firm* — Young Basile Hanlon & MacFarlane, P.C.

(57) ABSTRACT

A lifting arrangement for a construction machine comprises a main arm (3) which is provided with a pivot connector (4) at a proximate end thereof and an equipment connector (5) at a distal end thereof, a main arm support means (6) for pivotably supporting said pivot connector (4) of said main arm (3), wherein said main arm support means (6) is movable in a direction which includes at least a component in the front-rear direction with respect to said frame arrangement. Further a guiding means (7) is provided which is engaged to said main arm (3) at a guided portion (10) of said main arm (3) positioned between said pivot connector (4) and said equipment connector (5).

18 Claims, 27 Drawing Sheets

(56) References Cited

U.S. PATENT DOCUMENTS

| | | | | | |
|---|---|---|---|---|---|
| 3,148,789 | A | | 9/1964 | Gourjo | |
| 3,411,647 | A | * | 11/1968 | Zimmerman | E02F 3/3411 414/707 |
| 3,872,991 | A | * | 3/1975 | Pasideris | E02F 3/3405 414/707 |
| 4,235,567 | A | | 11/1980 | Pilch | |
| 6,132,163 | A | | 10/2000 | Andrews | |

FOREIGN PATENT DOCUMENTS

| | | | |
|---|---|---|---|
| CN | 102285327 | A | 12/2011 |
| CN | 203452106 | U | 2/2014 |
| GB | 2049615 | A | 12/1980 |
| WO | 2016123732 | A1 | 8/2016 |

OTHER PUBLICATIONS

Extended European Search Report, Application Serial No. 15162495.4-1712, filed Feb. 6, 2016, by S. Papadimitriou.

State Intellectual Property Office of the P.R. China; PCT International Search Report, Issued in Connection to PCT/CN2015/072096; Jul. 20, 2015; 4 pages; China.

State Intellectual Property Office of the P.R. China; PCT Written Opinion of the International Searching Authority, Issued in Connection to PCT/CN2015/072096; Jul. 20, 2015; 4 pages; China.

State Intellectual Property Office of the P.R. China; Report of Search Started, Issued in Connection to CN Application No. 2015800024507; 1 page; China.

State Intellectual Property Office of the P.R. China; The First Office Action, Issued in Connection to CN Application No. 2015800024507; 19 page; China.

European Patent Office; Communication Pursuant to Article 94(3) EPC, Issued in Connection to EP Application No. 15162495.4; Aug. 28, 2017; 4 pages; Europe.

* cited by examiner

LIFTING ARRANGEMENT FOR A CONSTRUCTION MACHINE

CROSS REFERENCE TO RELATED APPLICATION

This application claims the benefit of PCT/CN2015/072096, filed Feb. 2, 2015 the disclosure of which is incorporated herein in its entirety by reference.

The present invention relates to a lifting arrangement for a construction machine. In particular, the present invention relates to a lifting arrangement which can be advantageously applied to a wheel loader.

TECHNICAL BACKGROUND

Construction machines include those which are used for lifting heavy loads such as in mining or similar operations. Mobile construction machines having a lifting arrangement are known such as wheel loaders or the like. For such applications it is crucial to provide a maximum loading and lifting capacity for the lifting arrangement as this is the main factor affecting the operational efficiency of such construction machines. An operation of construction machines using lifting arrangements includes a loading operation of the material to be lifted at a lower level, a lifting operation for lifting the load to a higher level and an unloading operation e.g. for dumping or unloading the lifted load at the higher level.

In specific applications using a lifting arrangement which is mounted at the front area of mobile construction machines, the lifting capacity is not only limited by the available power driving actuators used for lifting the load. Rather, a weight distribution of such mobile construction machines is a limiting factor restricting the lifting capacity of such lifting arrangements as the mobile construction machine must remain stable in the course of the lifting operation. Consequently, variations of the weight distribution of the mobile construction machines or an increase of the total weight of the machine are considered in order to enhance the lifting capacity of the lifting arrangement. However, such variations in weight distribution or even an increase of the total weight of the mobile construction machine have clearly a negative influence on the drivability and the overall weight of the construction machine. Moreover, drive sources for driving the machine must be designed for such an increased weight of the machine which deteriorates the overall efficiency in view of a specified maximum lifting capacity. The above disadvantages have been accepted previously in order to provide construction machine having the desired lifting capacity.

SUMMARY OF THE INVENTION

It is the object of the present invention, to provide an improved lifting arrangement for a construction machine which enhances the loading and lifting capacity without negatively affecting the overall efficiency of the construction machine.

The object is solved by a lifting arrangement for a construction machine having the features of claim 1. Further advantageous developments of the invention are defined in the dependent claims.

According to a first aspect of the present invention, a lifting arrangement for a construction machine having a frame arrangement with a front frame portion and a rear frame portion is provided, wherein said lifting arrangement is mountable to said frame arrangement, preferably to said front frame portion of said construction machine. According to the present aspect of the invention, the lifting arrangement comprises the following:

A main arm which is provided with a pivot connector at a proximate end thereof and an equipment connector at a distal end thereof, a main arm support means for pivotably supporting said pivot connector of said main arm, wherein said main arm support means is moveable in a direction which includes at least a component in the front-rear direction with respect to said frame arrangement, an actuator for pivoting said main arm about said pivot connectors such that said equipment connector is movable between a lowered position and a lifted position, and a guiding means which is engaged to said main arm at a guided portion of said main arm positioned between said pivot connector and said equipment connector, wherein upon pivoting said main arm between said lowered position and said lifted position, said guided portion is guided by said guiding means along a curved path.

According to the invention, the main arm of said lifting arrangement is pivotable in order to provide a lifting movement at said equipment connector. In addition, a pivot center about which the main arm is pivoted is not stationary with respect to the frame arrangement of the construction machine. Rather, the pivot center of the main arm is supported at said support means which is movable in a direction which includes at least a component in the front-rear direction with respect to said frame arrangement.

Based on the guiding means designed according to the invention, the pivoting movement of the main arm effects a movement of the support means in order to provide a specific kinematic pattern of said movement upon moving the equipment connector between a lowered position and a lifted position.

According to an embodiment of the invention, said curved path along which said guided portion is guided by said guiding means is bulged towards said main arm support means.

Based on this structure, the equipment connector follows a specified path by guiding said guided portion of said main arm along said curved path which is bulged towards said main arm support means which effects a corresponding movement of said main arm support means in order to vary the position of the pivot center of the main arm upon moving said equipment connector between said lowered position and said lifted position.

According to an embodiment of the invention, by guiding said guided portion along said curved path upon pivoting said main arm between said lowered position and said lifted position, said main arm support means is forcedly moved in a direction which includes at least a component in the front-rear direction with respect to said frame arrangement.

Specifically, in this embodiment, the pivot center of the main arm is forcedly shifted or displaced in the front-rear direction upon moving said equipment connector between said lowered position and said lifted position. No further designated actuators for shifting or displacing said main arm support means are required by using said guiding means.

According to an embodiment of the invention, by guiding said guided portion along said curved path upon pivoting said main arm between said lowered position and said lifted position via an intermediate position, said main arm support means is forced in a rearward shifted position when said main arm passes said intermediate position, whereas said main arm support means is forced in a forward shifted position when said main arm approaches said lowered position or said lifted position, i.e. when moving from said intermediate position towards said lifted position or said lowered position.

According to this concept, the pivot center of the main arm is positioned further rearward when said main arm is in an intermediate position located between said lowered position and said lifted position compared to the situation in which said main arm is positioned in said lowered position or said lifted position. This means, that the kinematic pattern of the equipment connector upon moving the same between said lowered position and said lifted position is influenced by the position of said main arm support means.

According to an embodiment of the invention, a path of said equipment connector upon pivoting said main arm between said lowered position and said lifted position deviates from a circular path determined by a radius defined by an effective length of said main arm.

The effective length of said main arm is defined by a distance, i.e. a direct line, between said pivot center arranged at said main arm support means and said equipment connector. According to the basic concept of the present invention, the main arm, in particular said equipment connector, can be moved between said lowered position and said lifted position wherein the path of movement of said equipment connector does not correspond to the circular path having a radius corresponding to the effective length of said main arm. As consequence, a specified degree of freedom for determining or setting the movement path of said equipment connector can be provided. In particular, the movement path can be determined such that the objective problem underlying the present invention can be achieved, i.e. the loading or lifting capacity of the construction machine upon lifting a load by pivoting said main arm between said lowered position and said lifted position can be increased without affecting the total efficiency of the construction machine.

According to an embodiment of the invention, said path of said equipment connector upon pivoting said main arm between said lowered position and said lifted position follows a substantially vertical path. As stated above, the inventive arrangement allows the determination of a specified path along which said equipment connector follows upon lifting a load by pivoting said main arm between said lowered position and said lifted position. According to the present embodiment, the equipment connector follows a substantially vertical path which means that the movement of the equipment connector upon pivoting said main arm is maintained within a predetermined range. In particular, the predetermined range defining said substantially vertical path according to the present invention allows a specific deviation from a line vertically extending from the equipment connector in the lowermost position. It follows from the above that the substantially vertical path is not limited to a strictly vertically arranged line along which the equipment connector moves. Rather, any path which is limited within a range the width of which extends in the front-rear direction with respect to the construction machine is sufficient for achieving the solution according to the present invention.

Preferably, the deviation of the equipment connector from the vertical line extending from the equipment connector in the lowermost position is restricted to a specific deviation in the front-rear direction in order to limit the variance in the tilting momentum applied to the construction machine which is caused by the force exerted upon lifting the load. As consequence, a tilting moment exerted to the construction machine by the load in the intermediate position of the equipment connector can be limited to a specific extent thus enhancing the overall efficiency of the construction machine.

According to an embodiment of the invention, said main arm support means includes a main arm support link having a first end and a second end. The first end is pivotably connected to said pivot connector of said main arm and said second end is pivotably connected to said front frame portion. Said first end is movable in the direction which includes at least a component in the front-rear direction with respect to said frame arrangement.

According to the above embodiment, the arrangement for movably supporting the pivot connector of said main arm is realized by said main arm support link which provides a support for said pivot center of said main arm about which the main arm is pivoted, said pivot connector being movable at least with a component in the front-rear direction with respect to the construction machine. Although the main arm support link provides a circular path at its first end, the arrangement of said main arm support link can be such that a component of this circular movement is aligned to the front-rear direction with respect to the construction machine. In this case, the main arm support link extends towards the upper area in order to provide said component in the front-rear direction with respect to the construction machine when said main arm support link is pivotably moved upon lifting said equipment connector of said main arm. As alternative, said main arm support link can be arranged such that said main arm support link extends towards the downward area as long as it provides for a movement of said pivot center of said main arm which includes at least a component in the front-rear direction with respect to said frame arrangement.

According to an embodiment of the invention, said main arm support means includes a sliding element which is mounted to said front frame portion, said pivot connector of said main arm being pivotably and slidably connected to said sliding element, such that said pivot connector is moveable in a direction which includes at least a component in the front-rear direction with respect to said frame arrangement.

In the above alternative, the movement of said pivot connector of said main arm is achieved by allowing a sliding movement including a component in the front-rear direction with respect to the construction machine. The sliding element can be embodied as one or multiple guiding rails. The pivot connector of said main arm can be slidably mounted to the above mentioned one or multiple guiding rails. The one or multiple guiding rails can be straight or bent or otherwise shaped guiding rails.

According to an embodiment of the invention, said guiding means includes a guiding arm having a first end and a second end. The first end is pivotably mountable to said front frame portion and said second end is pivotably mounted to said main arm at said guided portion of said main arm positioned between said pivot connector and said equipment connector.

According to this embodiment, the movement of the guided portion of said main arm upon lifting said main arm is well-determined by using a very simple means. In particular, using pivotable linkages between elements forming the lifting arrangement enhances the lifetime and minimizes maintenance work. Moreover, in the context of the basic concept of the lifting arrangement according to the present invention, the kinematic pattern of movement of the equipment connector can be achieved as desired without the need of any control means or the like.

According to an embodiment of the invention, upon pivoting said main arm between said lowered position and said lifted position, the rotational direction of the pivoting movement of said main arm is opposite to the rotational direction of the pivoting movement of the above mentioned guiding arm. Due to this concept, the lifting arrangement can be designed as compact structure which is preferable in particular when applying the lifting arrangement to the front portion of the frame arrangement of the construction machine. Moreover, with the arrangement according to the above embodiment, the specified movement path of the equipment connector can be achieved in cooperation with the pivoting main arm and the pivoting guiding arm which rotate in opposite directions upon a lifting movement of the equipment connector.

According to an embodiment of the present invention, said guiding arm is equipped with an adjusting means for adjusting an effective length of said guiding arm. In this case, the effective length of said guiding arm is defined by the distance between a pivoting bearing at the first end of the guiding arm and a pivoting bearing at the second end of the guiding arm. By using an adjusting means for adjusting the effective length of said guiding arm, the degree of freedom in setting or determining the path along which the equipment connector is moved upon a lifting operation can be further increased.

According to an embodiment of the invention, said adjusting means is embodied as linear actuator for adjusting the distance between the first end and the second end of said guiding arm, in particular, between said pivoting bearing at the first end and said pivoting bearing at said second end of said guiding arm. In a preferred embodiment, the linear actuator is structured as hydraulic cylinder. Hydraulic actuators are present in the majority of construction machines and, therefore, this embodiment can be achieved without the need to provide additional driving means or the like. In any case, the invention can also be realized by operating the lifting arrangement without changing the effective length of said guiding arm. Rather, the adjusting means is provided in order to realize an option for enhancing the degree of freedom for moving the equipment connector.

According to an embodiment of the invention, said guiding means includes a guiding rail mounted to said front frame portion which is slidingly engaged to said guided portion of said main arm, said guiding rail providing said curved path. According to this alternative, said curved path for forcedly moving the guided portion of said main arm along said curved path is realized by the combination of said guiding rail which guides an element of said main arm, in particular, said guided portion. In this context, any type of guiding rail can be used as long as a specified path can be provided along which the guided portion of said main arm is guided. In order to realize the guiding of said guiding portion of said main arm, a sliding element can be provided which engages said guiding rail and which is arranged for sliding along the guiding path of said guiding rail.

According to an embodiment of the invention, said curved path, along which said guided portion is guided by said guiding means is a circular path. Providing a circular path is achieved with simple means such as a link which is pivotably supported at one end. The same advantage applies to the guiding means being a guiding rail as a guiding rail with a circular path can be easily produced. Moreover, such elements providing a circular path can be replaced without high machining effort which is a very important advantage of the simple arrangement provided by the present invention. In addition, in combination with the further elements of the lifting arrangement, the object of providing the specified path of the equipment connector which provides the above discussed advantage can be achieved as desired.

According to an embodiment of the invention, at least one of a bucket and a lifting fork for lifting heavy loads is tiltably mounted to said equipment connector. A bucket can be used to load, lift and unload bulky matter such as in mining or the like. A lifting fork for lifting heavy loads can be used to lift large single piece loads. Both can be understood as equipment to be mounted at the equipment connector. Preferably, the equipment mountable to said equipment connector is arranged with the option of tilting the equipment. The above mentioned bucket or lifting fork are not limiting the invention. Rather, any equipment can be mounted to the equipment connector with our without tilting option as long as a lifting operation is involved.

According to a further aspect of the present invention, a wheel loader is provided which has an articulating frame arrangement consisting of a front frame portion and a rear frame portion which are articulatingly interconnected for providing an articulating steering, wherein the wheel loader comprises a lifting arrangement according to one of the above mentioned embodiments.

As discussed above, the lifting arrangement can be constructed as compact structure while the advantage of providing the specified path of the equipment connector can be achieved. When applied to a wheel loader, such a compact arrangement is particularly advantageous due to the fact that an articulating steering is provided between a front frame portion and a rear frame portion.

Accordingly, it is a specific advantage of this aspect of the present invention, that elements forming said lifting arrangement are supported by said front frame portion of said articulating frame arrangement and are articulated together with said front frame portion with respect to said rear frame portion upon steering actions.

In this case, the equipment connected to the equipment connector is preferably provided in front of the front frame portion, wherein the elements of said lifting arrangement are supported by said front frame portion. As the front frame portion in an articulating frame arrangement substantially follows the direction of the front wheels, the operation of the wheel loader following this concept can be operated without any surprising changes in behavior compared to a standard wheel loader. However, it is also possible to provide a part of the elements forming the lifting arrangement at the rear frame portion. Also, it is possible to provide all elements of the lifting arrangement at the rear frame portion depending on the specific needs.

According to the above invention, the lifting arrangement provides a movement pattern of the equipment connector along a specified path. This specified path is designed such that the protruding length of the equipment connector carrying the equipment is reduced in the intermediate position of lifting compared to a prior art lifting arrangement in which the main arm is pivotably mounted at a stationary pivot center. As consequence, the tilting moment exerted to the construction machine by the load acting on said equipment connector can be reduced in the intermediate position of said main arm compared to prior art lifting arrangements. Based on this advantage, the loading or lifting capacity which is limited by the maximum tilting moment exerted in the intermediate position of the main arm can be increased without changing the overall weight distribution or increasing the total weight of the construction machine. Due to this fact, the efficiency of the construction machine is enhanced. From a different perspective, it is possible to provide a construction machine with a predetermined lifting or loading capacity in which the total weight of the construction machine can be reduced such that all settings including wheels, bearings, drive forces and the like can be reduced in capacity with respect to a prior art construction machine. As result, the fuel consumption of such a novel construction machine will be reduced dramatically when compared to prior art machines having the same lifting or loading capacity.

It is noted that the above embodiments and alternatives can be applied as single measure or in combination. Moreover, it is explicitly noted that the application of the lifting arrangement is not limited to wheel loader having an articulating frame arrangement. Due to the compact structure of the inventive lifting arrangement, the application to any construction machine provides the same advantage as discussed above.

BRIEF DESCRIPTION OF THE DRAWINGS

The invention is explained based on the enclosed drawings showing an exemplary construction machine equipped with a lifting arrangement according to various embodiments and modifications. It is noted that the following drawings should not be considered as limiting the invention set out in the claims. Moreover, the illustrated construction machine is merely an example and the lifting arrangement according to the invention is applicable to various types of construction machines.

DETAILED DESCRIPTION OF THE EMBODIMENTS

In the following, embodiments and modifications of the present invention are explained in detail based on the drawings. It is noted that the below discussed embodiments can be combined with each other and the invention is not specifically restricted to the structure and arrangement of the specific embodiments and modifications discussed below.

General Overview

The present invention relates to a lifting arrangement which is applicable to construction machines in general. In the following embodiments, the lifting arrangement is illustrated and explained as structure of a construction machine which is embodied as wheel loader. However, the specific application of the lifting arrangement according to the present invention is not limited to the application to a wheel loader. Rather, the lifting arrangement according to the present invention can be applied to drivable construction machines of any type such as loaders having wheels or crawler track chains or even a combination of both. Moreover, the steering type is not limited to the below discussed optional articulating steering arrangement. Rather, the lifting arrangement is applicable to construction machines having any type of steering arrangements such as articulating steering arrangements, skid steering arrangements or any other type.

Figure 1:
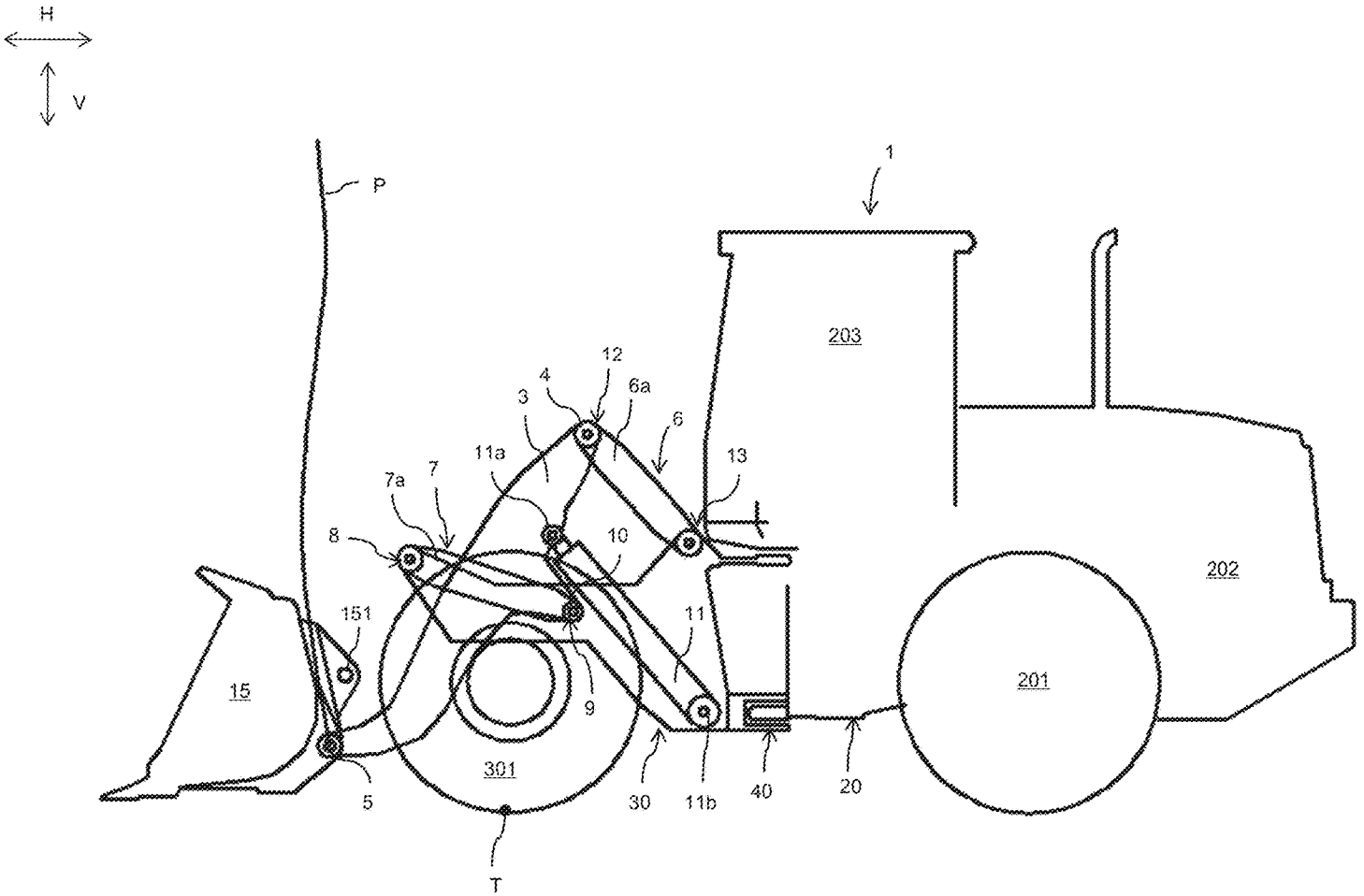
FIG. 1 illustrates a construction machine equipped with a lifting arrangement according to first embodiment in a lowered position.

The construction machine to which the lifting arrangement according to the present invention is applicable is briefly explained based on the illustration of FIG. 1. FIG. 1 shows the construction machine 1 in a simplified side view. Elements which are not essential for the invention are omitted.

The construction machine 1 comprises a front frame portion 30 and rear frame portion 20. In the example according to FIG. 1, a pair of front wheels 301 is mounted to the front frame portion 30 and a pair of rear wheels 201 is mounted to the rear frame portion 20. The front frame portion 30 is mounted to the rear frame portion 20 with an articulating steering arrangement 40. The articulating steering arrangement 40 is well known to the skilled person and comprises one or multiple bearings for providing an articulating mount between the front frame portion 30 and the rear frame portion 20 with a pivoting axis being arranged substantially along the vertical axis of the construction machine 1, i.e. perpendicular with respect to the longitudinal direction of the construction machine 1. The articulating steering arrangement 40 provides a tilting between the front frame portion 30 and the rear frame portion 20 in order to provide a steering by changing the angle enclosed between the rotation axis of the front wheels 301 and the rotating axis of the rear wheels 201. The articulating steering arrangement 40 can be driven by a not illustrated actuator, such as a hydraulic actuator. The type and structure of the articulating steering arrangement 40 is not essential to the invention and can be adapted as required.

The construction machine 1 according to the example shown in FIG. 1 comprises an operator's cab 203 which is mounted to the rear frame portion 20. Inside the operator's cab 203, space for the operator is provided and the required operating and control elements which are not illustrated are accessible by the operator. The operator's cab 203 comprises not illustrated windows in order to provide visibility of the surrounding field for the operator.

An engine compartment 202 is provided at the rear frame portion 20 which houses one or multiple power sources for providing power required to operate the construction machine 1. The power sources can include but are not limited to an internal combustion engine, such as a Diesel engine, which can be coupled to further equipment such as hydraulic pumps, generators and the like. The power source is used to provide power for driving the front wheels 301 and/or the rear wheels 201 as well as for providing power for actuators besides other elements of the construction machine.

The front frame portion 30 extends in the forward direction with respect to the rear frame portion 20. In the present example, the front frame portion 30 is located in front of the operator's cab 203 and the engine compartment 202. However, the application of the lifting arrangement according to the present invention is not limited to the construction machine 1 having such an arrangement.

Upon a steering operation, the front frame portion 30 tilts with respect to the rear frame portion 20, the operator's cab 203 and the engine compartment 202. However, it is also possible to provide a modified steering arrangement such as a single wheel steering, front wheel steering or rear wheel steering while the articulating steering arrangement is omitted or provided only as option.

In the following, the lifting arrangement according to the present invention is explained in various embodiments, wherein the lifting arrangement is mounted to the front frame portion 30 of the above explained exemplary construction machine 1 embodied as wheel loader.

First Embodiment

The lifting arrangement according to the first embodiment comprises a main arm 3 having a pivot connector 4 at a proximate end and an equipment connector 5 at a distal end thereof. The pivot connector 4 is pivotally supported at a main arm support means 6 which includes a main arm support link 6*a* in the present embodiment. The main arm support link 6*a* has a first end 12 and a second end 13, the first end 12 being pivotably connected to the pivot connector 4 of the main arm 3 and the second end 13 being pivotably connected to an element of the front frame portion 30. The connection between the pivot connector 4 of the main arm 3 and the first end 12 of the main arm support link 6*a* can be provided as bearing arrangement of a suitable type in order to provide a sliding rotation of the main arm 3 with respect to the main arm support link 6*a*.

The main arm support link 6*a* is pivotably mounted to the front frame portion 30 at its second end 13. In order to provide such a pivotable mount of the main arm support link 6*a* to the front frame portion 30, a rotating bearing of a suitable type is arranged for providing the pivotable movement of the main arm support link 6*a* with respect to the front frame portion 30.

The main arm support link 6*a* is arranged such that a rotation or pivoting movement of the main arm support link 6*a* provides a movement of the first end 12 in a direction which at least includes a component in the front-rear direction of the construction machine 1. For this reason, the main arm support link 6*a* is directed in an upwards direction with a specific inclination from the vertical direction in the situation in FIG. 1.

The main arm 3 comprises a guided portion 10 which is provided between the pivot connector 4 and the equipment connector 5. In the present embodiment, the guided portion 10 is also offset by a predetermined amount from a line connecting the pivot connector 4 and the equipment connector 5. However, this offset is not essential for the present invention and rather a preferred arrangement.

The lifting arrangement according to the present invention further includes a guiding means 7 which includes in the embodiment shown in FIG. 1 a guiding arm 7*a* having a first end 8 and a second end 9. The first end 8 is pivotably mounted to the front frame portion 30 and the second end 9 is pivotably mounted to the main arm 3 at the guided portion 10. The second end 9 is pivotably mounted to a bearing of a suitable type provided in the area of the guided portion 10 of the main arm 3 in order to provide a pivotable movement of the guiding arm 7*a* relative to the main arm 3. On the other hand, the first end 8 is pivotably mounted to the front frame portion with a bearing of a suitable type in order to provide a pivotable movement of the guiding arm 7*a* with respect to the front frame portion.

An actuator 11 is provided in the lifting arrangement. The actuator has a first end 11*b* which is pivotably mounted to the front frame portion 30 and a second end 11*a* which is pivotably mounted to the main arm 3. The actuator is embodied as linear actuator such as a hydraulic actuator in the present embodiment but not limited thereto. Upon operating the actuator 11, the distance between the first end 11*b* and the second end 11*a* can be changed e.g. by introducing pressurized fluid into pressure chambers of the actuator 11.

At the equipment connector 5 of the main arm 3, a bucket 15 is provided which is an example of equipment which can be mounted to the main arm. The bucket comprises a tilt connector 151 for tiltably operating the bucket. The arrangement for tilting the bucket 15 is not illustrated in FIG. 1 and will be explained in further detail below.

In the exemplary arrangement shown in FIG. 1, the guiding arm 7*a* is directed rearwards with respect to the first end 8 of the guiding arm 7*a*. In FIG. 1, the lifting arrangement is shown in a position which is defined as lowered position in which the bucket 15 is positioned at a lowermost position in which the bucket is able to admit material to be lifted and touches the ground. It is, however, possible to provide a lifting range which extends below the ground limit if needed.

In the following, an operation of the lifting arrangement according to the present invention is explained in detail based on the illustrations of FIGS. 1-3.

In FIG. 1, the lifting arrangement is illustrated in the lowered position. In this situation, the main arm is rotated downwards as illustrated in FIG. 1. This is achieved by retracting the actuator n which is provided for operating the main arm 3. The position of the main arm 3 is determined by the linkage between the guiding arm 7*a* and the main arm support link 6*a*. In other words, the position of the pivot connector 4 of the main arm 3 can be changed by changing the rotational position of the main arm support link 6*a*, whereas the guiding arm 7*a* determines, due to its rotational connection between the front frame portion 30 and the guided portion 10 of the main arm 3, the position of the pivot connector 4 depending on the rotational position of the main arm 3. As such, the lifting arrangement provides a link-based transmission which uniquely determines the position of the main arm 3.

Upon actuating the actuator 11, the main arm 3 is rotated in the clockwise direction in FIG. 1. With this rotation, the main arm 3 is rotated with respect to the main arm support link 6*a*. At the same time, the guiding arm 7*a* is rotated in the counter clockwise direction. When the guiding arm 7*a* rotates in the counter clockwise direction, the guided portion 10 of the main arm 3 is forced along a circular path due to the constant distance between the first and second ends 8, 9 of the guiding arm 7*a*. The circular path provided by the rotation of the guiding arm 7*a* is bulged towards the main arm support means including, in the present embodiment, the main arm support link 6*a*.

Figure 2:
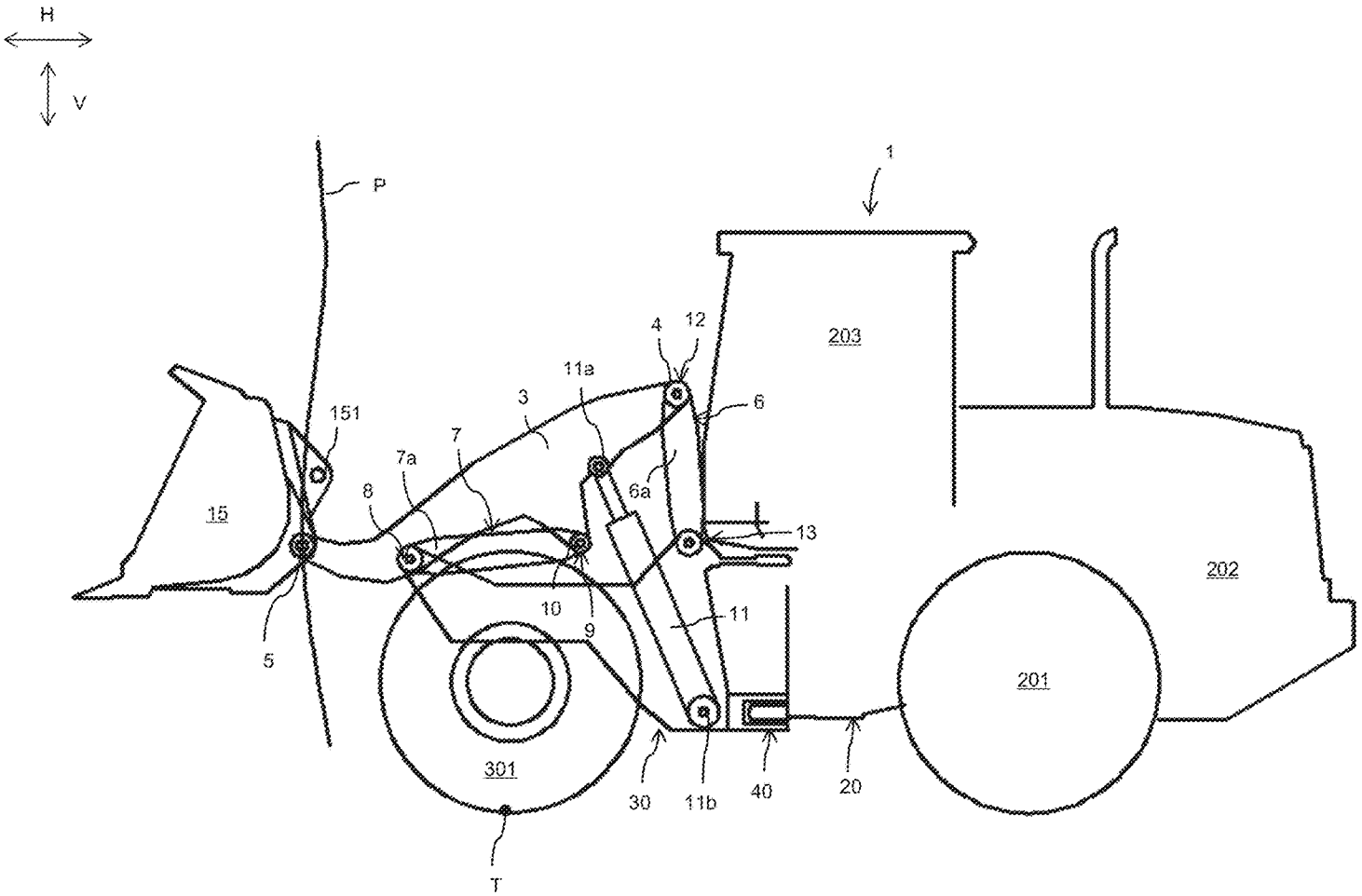
FIG. 2 illustrates a construction machine equipped with a lifting arrangement according to the first embodiment in an intermediate position.

FIG. 2 shows the lifting arrangement of FIG. 1 in an intermediate position which is lifted from the lowered position by a predetermined amount. As can be seen, the guiding arm 7*a* is rotated from the position shown in FIG. 1 in the counter clockwise direction. In this context, the position of the second end 9 of the guiding arm 7*a* has moved with a component of movement in the rearward direction with respect to the construction machine 1. In the same context, the main arm 3 has rotated in the clockwise direction and the bucket 15 mounted to the equipment connector has lifted by a predetermined amount. Due to the fact, that the guided portion 10 of the main arm 3 is forced in the rearward direction by the predetermined movement path of the second end 9 of the guiding arm 7*a*, the main arm support link 6*a* is rotated in the clockwise direction about its second end 13 which is mounted to the front frame portion 30. Therefore, the position of the first end 12 of the main arm support link 6*a* is moved together with the pivot connector 4 of the main arm 3 in the rearward direction with respect to the construction machine.

Figure 3:
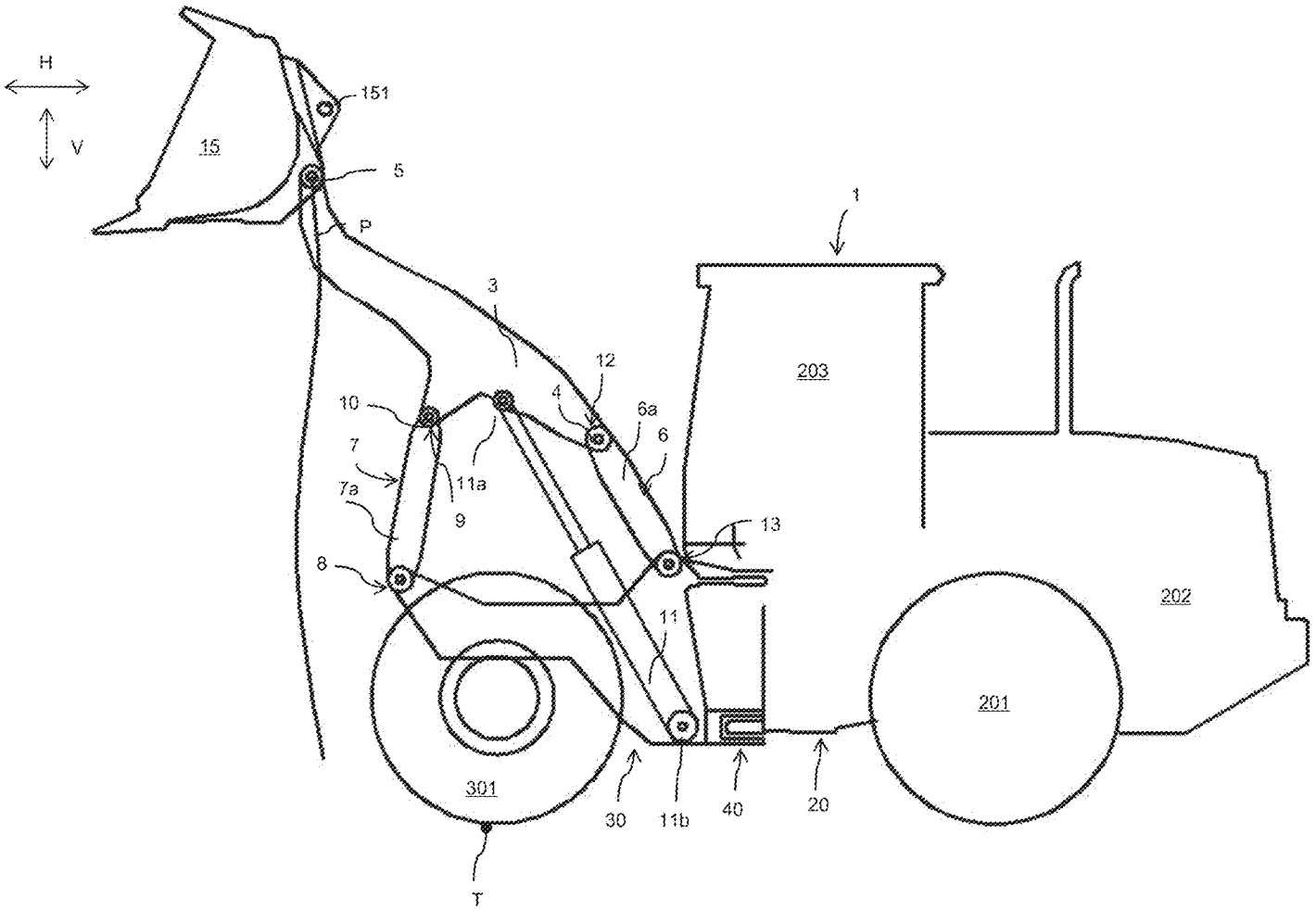
FIG. 3 illustrates a construction machine equipped with a lifting arrangement according to the first embodiment in a lifted position.

Upon a further operation of the actuator 11, the main arm 3 is further rotated in the clockwise direction and reaches a lifted position shown in FIG. 3. In this position, the bucket 15 mounted to the equipment connector 5 of the main arm 3 has reached a position which is higher than the intermediate position shown in FIG. 2. This position is the maximum lift position of the bucket 15 which can be achieved with the embodiment shown in FIGS. 1-3. Upon further rotating the main arm 3 in the clockwise direction, the guiding arm 7*a* is further rotated in the counterclockwise direction and forces the guided portion 10 of the main arm 3 further along the circular path. As the second end 9 of the guiding arm 7*a* has moved forward with respect to the position shown in FIG. 2, the main arm support link 6*a* is rotated in the counterclockwise direction from the position shown in FIG. 2. Therefore, the position of the first end 12 supporting the pivot connector 4 of the main arm 3 is further forward compared to the position thereof shown in FIG. 2.

Based on the above operation, the bucket 15 can be moved from the lowered position shown in FIG. 1 to the lifted position shown in FIG. 3 through the intermediate position shown in FIG. 2. Based on the inventive arrangement comprising the guiding arm 7*a* and the main arm support link 6*a*, the equipment connector 5 is forced along a predetermined movement path which is shown as path P in the drawings. In the present illustration, the path P is formed with an S-shape but basically follows a vertical path throughout the movement of the equipment connector from the lower most position to the upper most position. In particular, the path P deviates from a circular path which is achievable with prior art lifting arrangements in which the pivot connector 4 of the main arm 3 is immovably and stationary with respect to a frame portion of the construction machine 1. According to the present invention, the movement of the pivot connector 4 of the main arm is achieved by providing the movable support means 6 and the guiding means 7 which forces the main arm 3 to a specified movement pattern leading to a basically vertical movement range of the equipment connector 5.

In the following, the advantages of the present invention are explained based on the above embodiment. The lifting capacity of construction machines of this type are crucial for the operational efficiency of the machine. In case that the construction machine is supposed to the operated for lifting high loads from the lowered position of the bucked to the lifted position of the bucket, the tilting moment exerted by the load to the construction machine 1 must be considered. In this context, the point of contact of the front wheels 301 must be considered as tilting point T of the construction machine which is indicated in FIGS. 1-3 at one of the front wheels 301. As the bucket protrudes from the tilting point T in the forward direction, a tilting moment in the counterclockwise direction in FIG. 1 is exerted to the construction machine. As countermeasure, the weight distribution of the construction machine in particular at the rear side thereof must be appropriately determined.

Considering a prior art lifting arrangement, upon lifting a load based on a main arm having an equipment connector which follows a circular path upon a movement between the lowered position and the lifted position, the protruding distance of the equipment connector and the load acting on the equipment connector protrudes further in the intermediate position than in the lowered position or the lifted position. According to the present invention, the protruding distance in the horizontal direction between the tilting point T defined as point of contact of the front wheels 301 on the ground and the equipment connector is decreased in particular in the intermediate position compared to the known arrangement in which the equipment connector 5 follows a circular path.

Based on the inventive lifting arrangement, the load capacity of the construction machine 1 can be increased due to the fact that the tilting moment in the intermediate position of the equipment connector to the construction machine is decreased. On the other hand, the construction machine can be downsized while maintaining the same load capacity by using the inventive concept discussed above.

The path P shown in the drawings is only an example in order to illustrate that the path P deviates from a circular path which is achieved by prior art lifting arrangements. Depending on the detailed setting of the linking mechanism, i.e. the setup of distances and length of the links, the shape of the path P can be influenced appropriately. In context of the present invention, the path P can be considered as vertical path as it deviates from the circular path. It is crucial for the present invention that the path P remains within a predetermined range of a distance between the tilting point T defined by the point of contact of the front wheels 301 with the ground and the vertical distance to the path P.

A further advantage of the above discussed lifting arrangement shown in FIGS. 1-3 is that the structure is based on mechanical components only and a single actuator is sufficient for providing the vertical lift operation. That is, no further actuator for providing the vertical lift is required and a complex control system is not needed.

In addition, due to the specific arrangement of the main arm support means 6 and the guiding means 7 which interact with the main arm 3 in the above explained manner, a very compact arrangement is achievable which does not require the provision of elements of the lifting arrangement at the rear section of the construction machine. As such, this simple lifting arrangement is well applicable to wheel loaders using an articulating steering system which provide only a limited space at the front frame portion for mounting the lifting arrangement.

Second Embodiment

Figure 4:
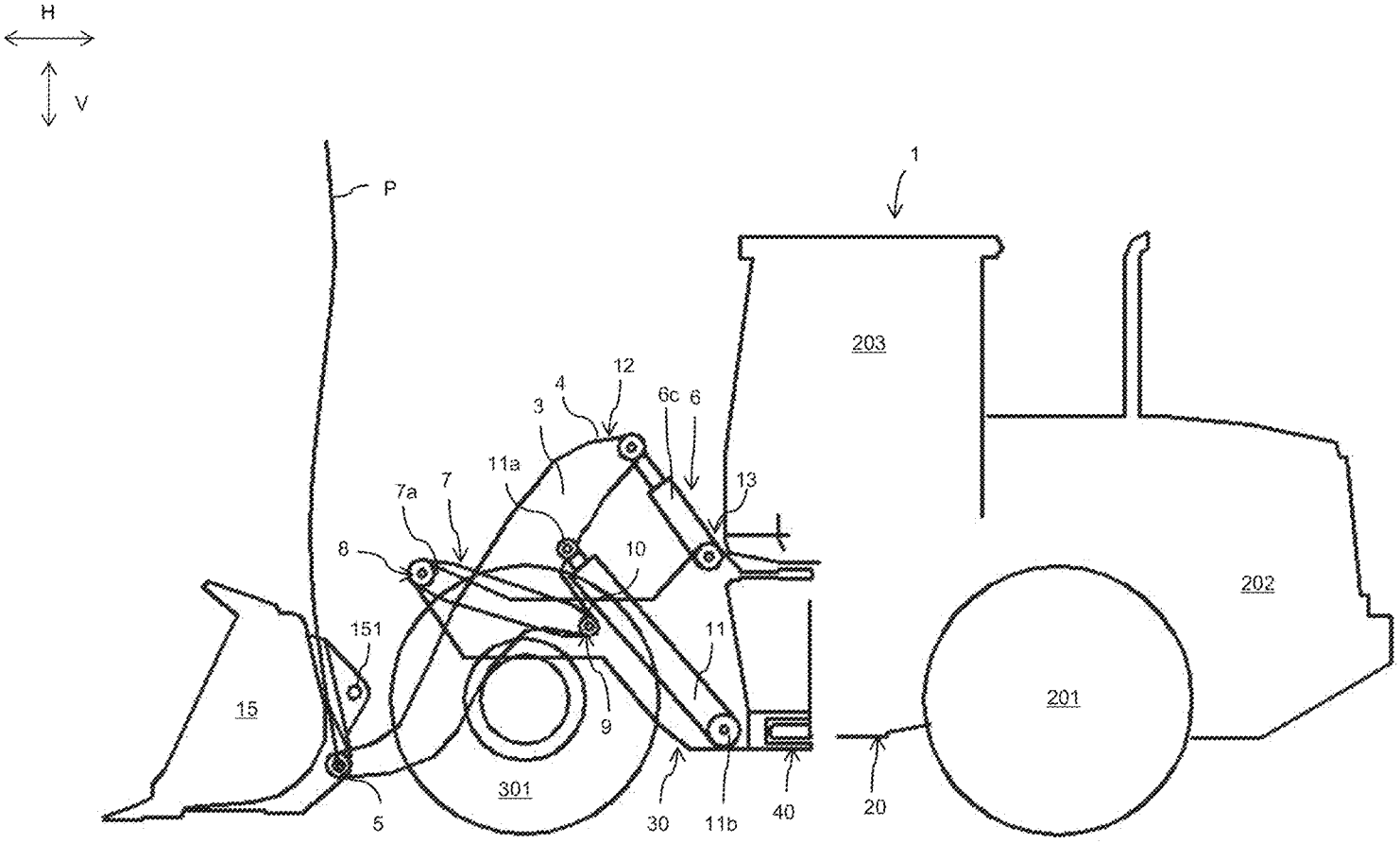
FIG. 4 illustrates a construction machine equipped with a lifting arrangement according to a second embodiment in a lowered position.
Figure 5:
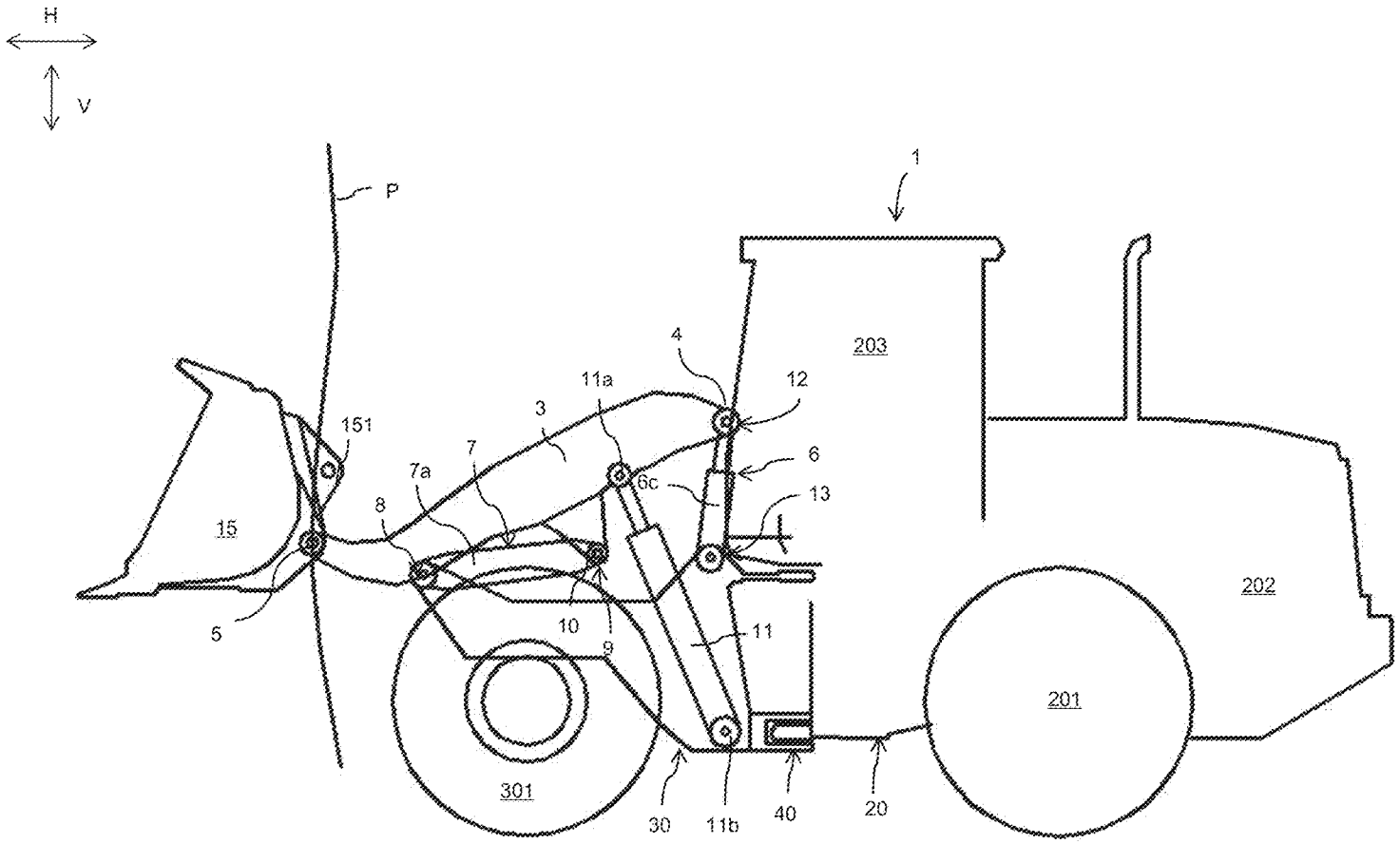
FIG. 5 illustrates a construction machine equipped with the lifting arrangement according to the second embodiment in an intermediate position.
Figure 6:
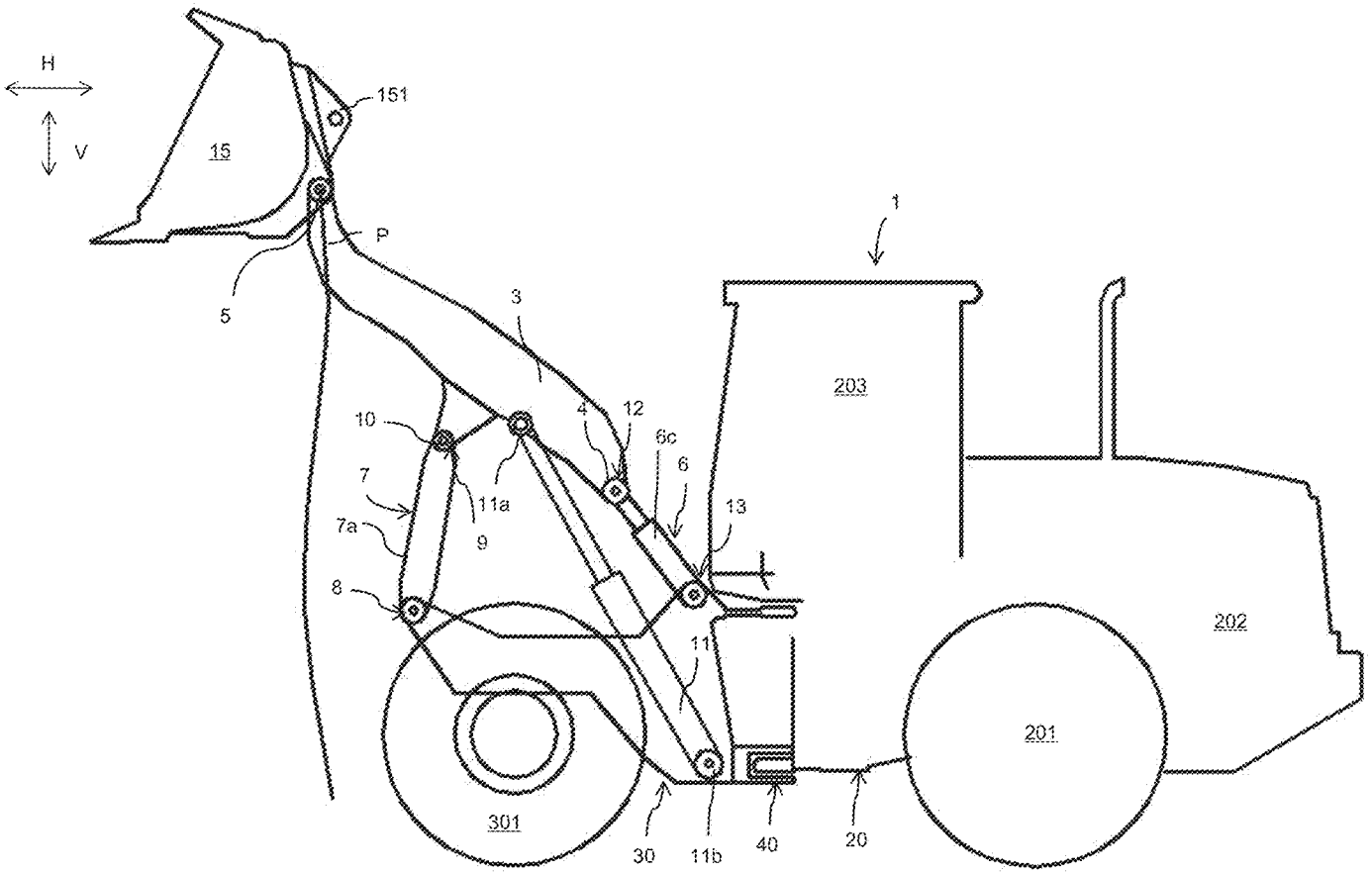
FIG. 6 illustrates a construction machine equipped with the lifting arrangement according to the second embodiment in a lifted position.

A second embodiment of the present invention is explained based on FIGS. 4-6. In the following, only differences between the first embodiment and the present second embodiment will be addressed. All remaining structures are basically the same as explained for the first embodiment.

The lifting arrangement according to the second embodiment in the lowered position is shown in FIG. 4. While in the first embodiment the main arm support means 6 includes the main arm support link 6*a*, the main arm support means 6 according to the second embodiment includes a main arm support actuator 6*c*. The actuator 6*c* has a first end 12 and a second end 13. The first end 12 of the actuator is pivotably connected to the pivot connector 4 of the main arm 3. The second end 13 is pivotably connected to the front frame portion 30.

The main arm support actuator 6*c* is arranged for changing the distance between the first end 12 and the second end 13 by extending or retracting operations. The basic function of the main arm support actuator 6*c* is the same as explained with respect to the first embodiment. However, as additional function, the distance between the first end 12 and the second end 13 of the main arm support actuator 6*c* can be changed in order to adapt the kinematic pattern along which the main arm 3 of the lifting arrangement moves upon actuating the main actuator 11. For example, it is possible to adapt the extension distance between the first end 12 and the second end 13 of the main arm support actuator 6*c* in the course of the lifting operation of the lifting arrangement. Moreover, it is possible to set the extension position of the main arm support actuator 6*c* to a first length in the lowered position shown in FIG. 4. In the course of the lifting operation of the lifting arrangement, the extension length of the main arm support actuator 6*c* can be set to a second length, being shorter than the first length, upon reaching the intermediate position shown in FIG. 5. In the course of further lifting the lifting arrangement, the extension length of the main arm support actuator 6*c* can be reset to the first length upon reaching the lifted position shown in FIG. 6. This is only an example and the specific details of setting the length of the main arm support actuator 6*c* can be adapted as needed.

It is possible to operate the main arm support actuator 6*c* with a manual operation by the operator of the construction machine 1. However, it is also possible to include a control system based on position sensors for sensing the position of specific elements of the lifting arrangement in order to automatically set the extension length of the main arm support actuator 6*c* for optimizing the shape of the path P which the equipment connector 5 follows upon a lifting operation. As further advantage, it is possible to increase the extension length of the main arm support actuator 6*c* at the maximum lift position in order to shift the main arm 3 in a forward direction with respect to the construction machine 1 e.g. for reaching beyond walls of containers for dumping load to be unloaded from the bucket 15.

It is noted that the additional arrangement of the actuator function of the main arm support means 6 provides the same advantages as explained above. Also, this arrangement is not strictly required for achieving the above object and advantages.

Third Embodiment

Figure 7:
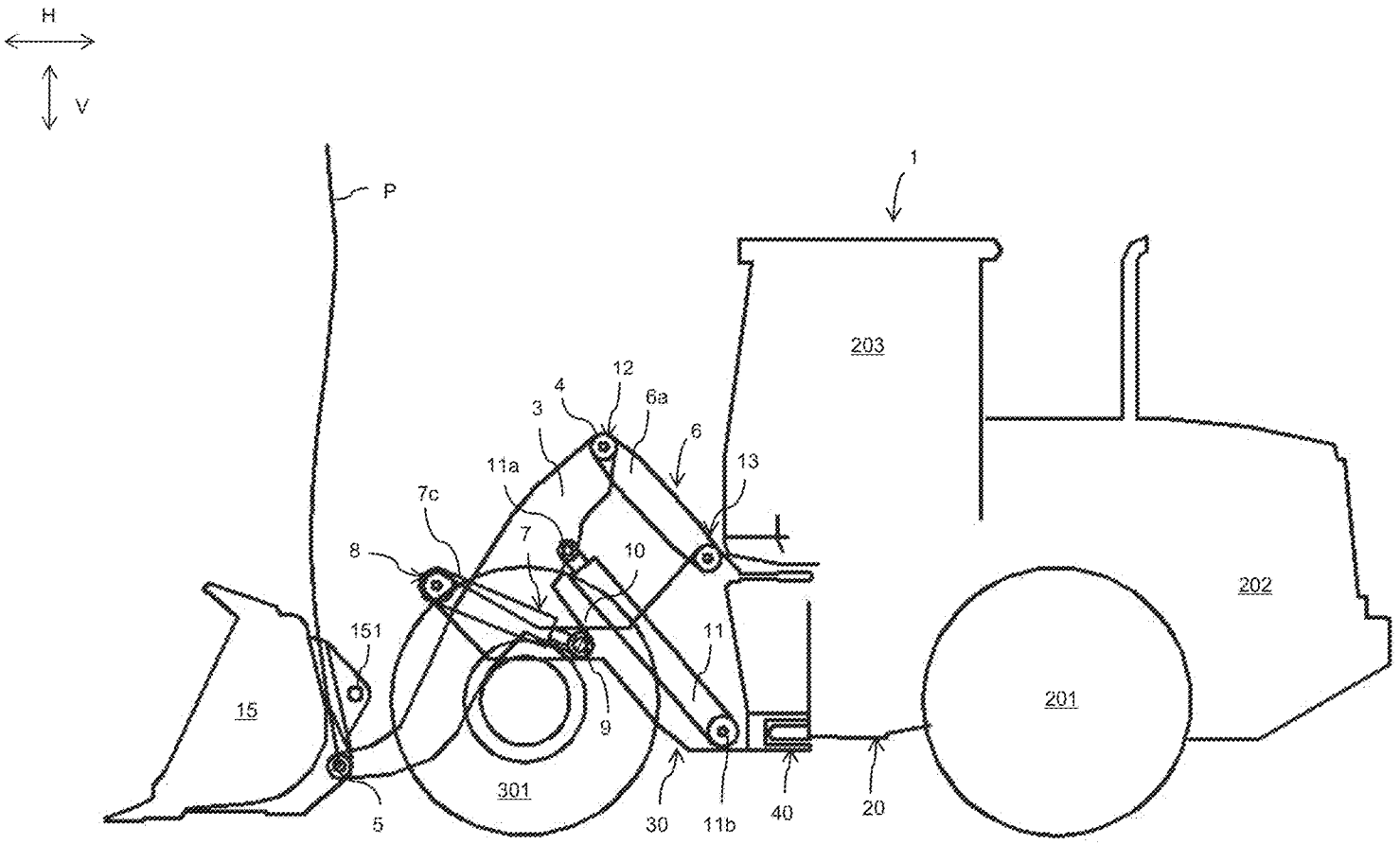
FIG. 7 illustrates a construction machine equipped with a lifting arrangement according to a third embodiment in a lowered position.
Figure 8:
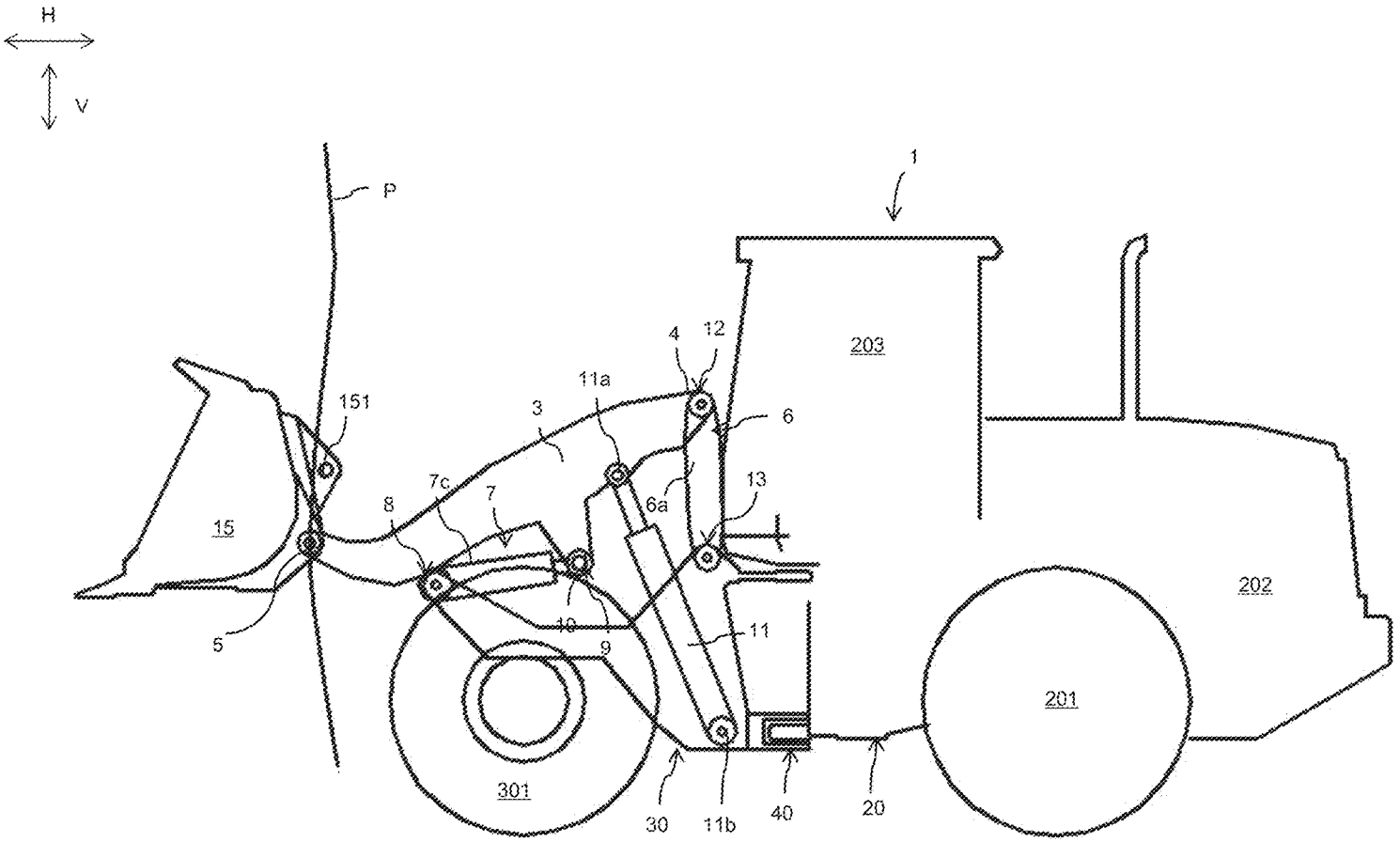
FIG. 8 illustrates a construction machine equipped with the lifting arrangement according to the third embodiment in an intermediate position.
Figure 9:
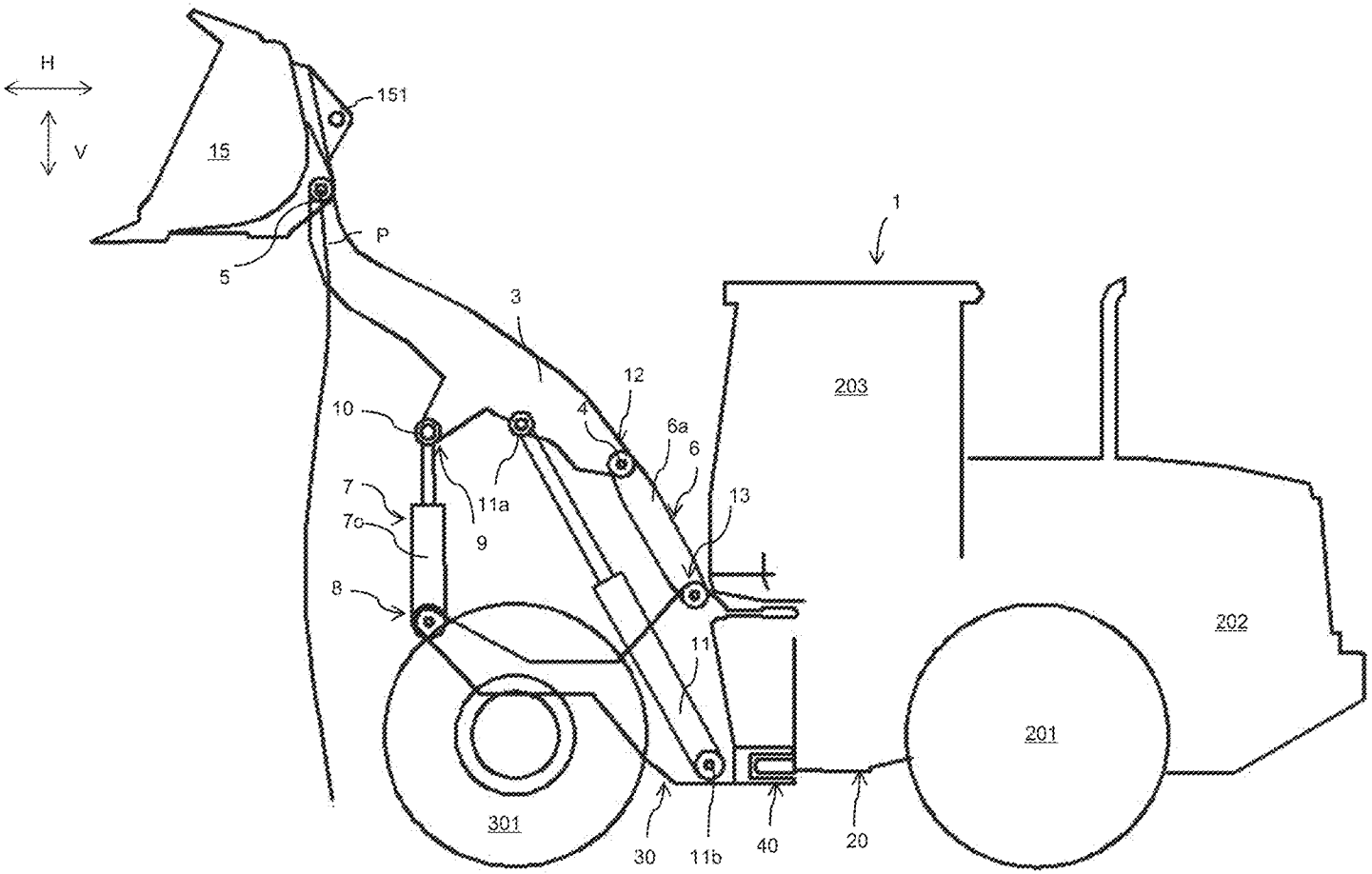
FIG. 9 illustrates a construction machine equipped with the lifting arrangement according to the third embodiment in a lifted position.

A third embodiment of the present invention is explained based on FIGS. 7-9. In the following, only differences between the first embodiment and the present third embodiment will be addressed. All remaining structures are basically the same as explained for the first embodiment.

In the first embodiment, the guiding means 7 includes the guiding arm 7*a*. In contrast, the present third embodiment is arranged with a guiding means 7 which includes a guiding actuator 7*c* as shown in FIG. 7. The guiding actuator 7*c* according to the third embodiment includes a first end 8 and a second end 9, wherein the first end 8 is pivotably mounted to the front frame portion 30 and the second end 9 is pivotably mounted to the main arm 3 at the guided portion 10. The guiding actuator 7*c* is embodied as linear actuator with an adjustable extension length between the first end 8 and the second end 9. The actuator is preferably embodied as hydraulic actuator which can be operated for extending or retracting. FIG. 7 shows the lifting arrangement according to the third embodiment in the lowered position. Upon lifting the lifting arrangement from the lowered position to the intermediate position shown in FIG. 8, the guided portion of the main arm is guided along a specific path determined by the guiding means 7. In the present case, the guiding means 7 includes the guiding actuator 7*c* having an adjustable extension length. Accordingly, the path along which the guided portion 10 of the main arm 3 is guided can be adjusted.

In the illustration in FIG. 8, the extension length is decreased in the intermediate position of the lifting arrangement with respect to the lowered position thereof shown in FIG. 7. Moreover, the extension length of the guiding actuator 7*c* can be extended with respect to the lowered position upon approaching the lifted position as shown in FIG. 9. Accordingly, the movement pattern of the equipment connector can be adapted appropriately such that the optimum path P is achievable. In addition, it is possible to increase the total lifting height of the lifting arrangement by employing the additional feature of said guiding actuator 7*c* which enables an increase of the maximum lifting height of the lifting arrangement. It is noted that the guiding actuator 7*c* can be operated manually by the operator or automatically by using a control system having sensors for determining the position of elements of the lifting arrangement.

It is noted that the additional arrangement of the actuator function of the guiding means 7 provides the same advantages as explained above. Also, this arrangement is not strictly required for achieving the above object and advantages. It is also noted that the third embodiment can be combined with the second embodiment in order to provide the additional advantages of both alternatives which can be realized in the lifting arrangement.

Fourth Embodiment

Figure 10:
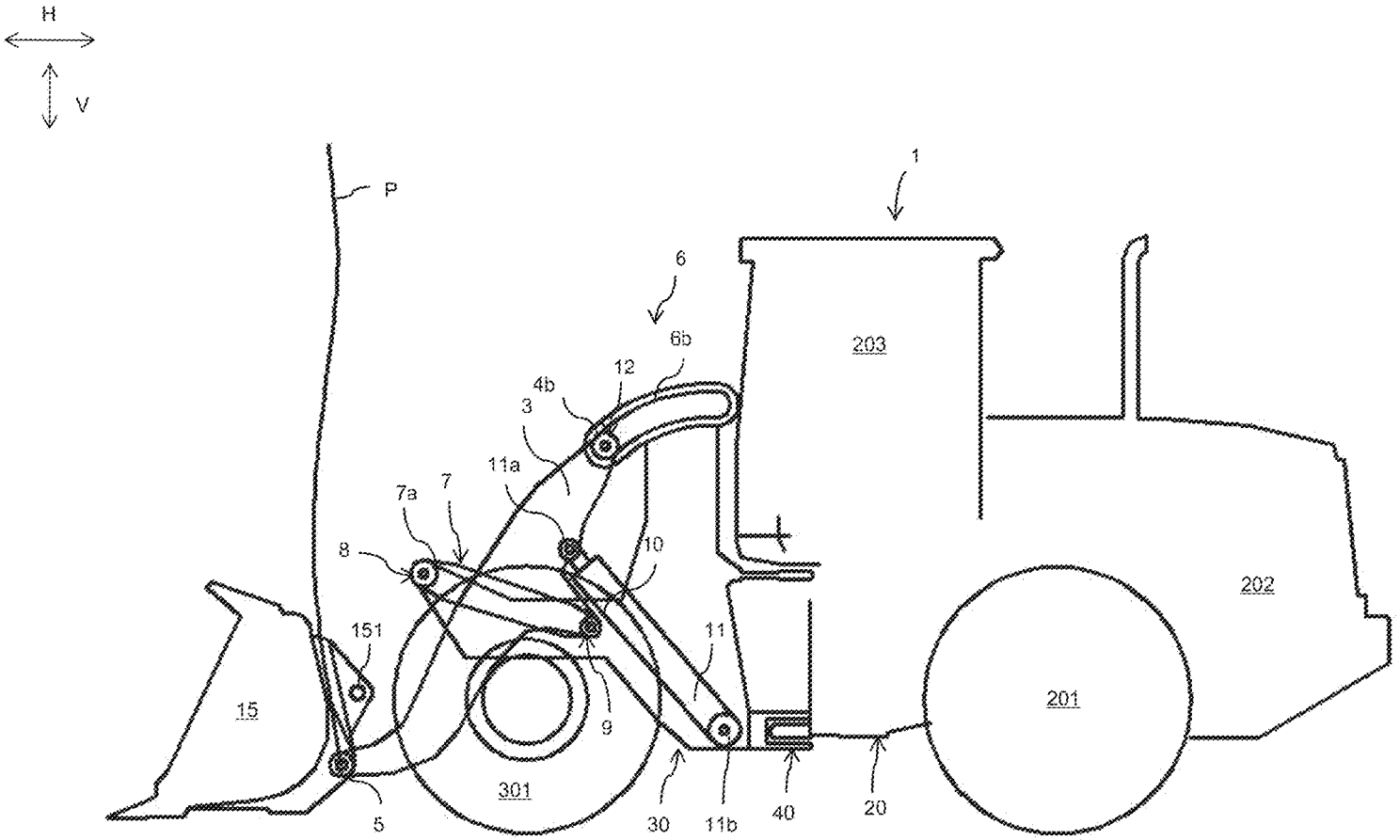
FIG. 10 illustrates a construction machine equipped with a lifting arrangement according to a fourth embodiment in a lowered position.
Figure 11:
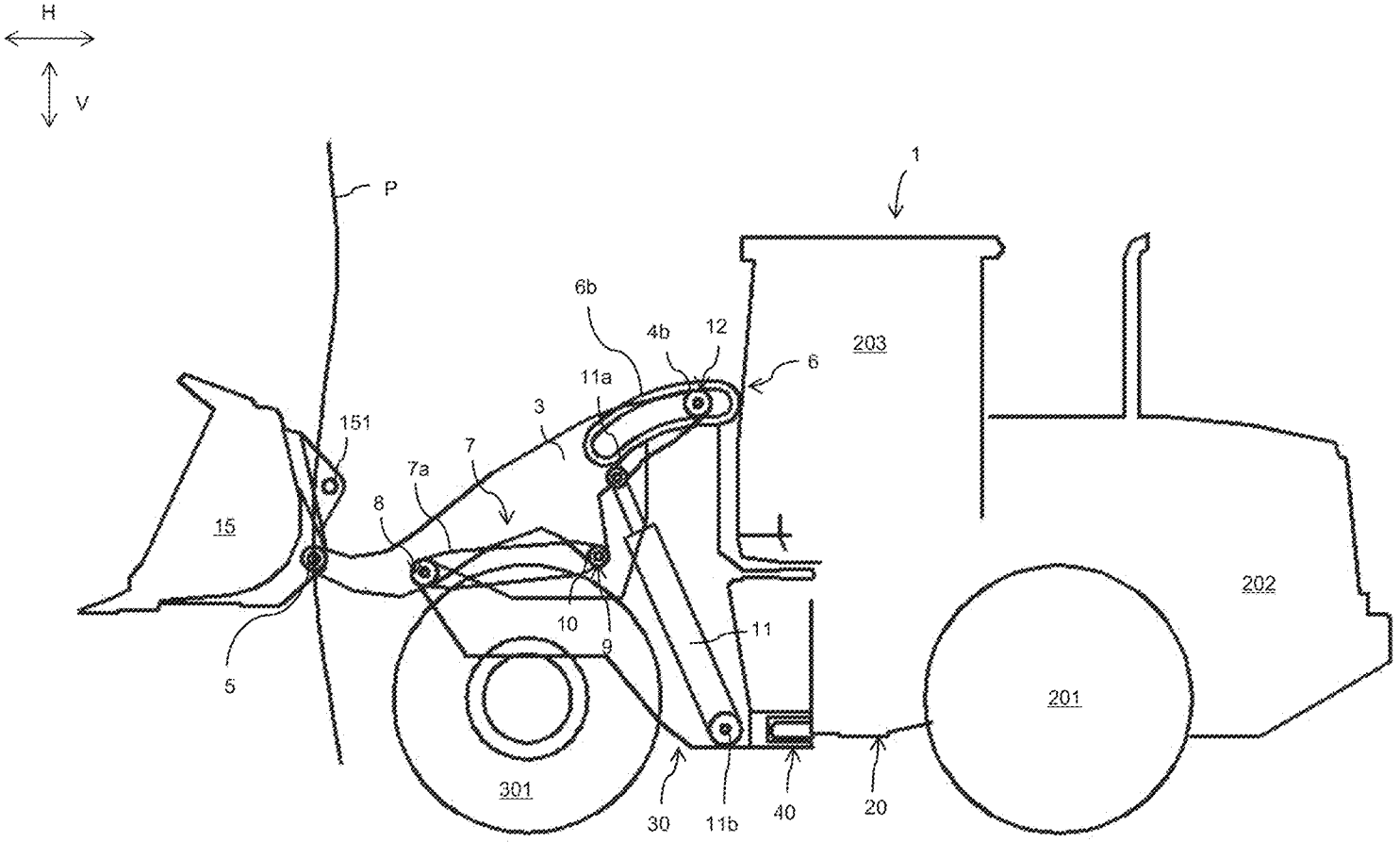
FIG. 11 illustrates a construction machine equipped with the lifting arrangement according to the fourth embodiment in an intermediate position.
Figure 12:
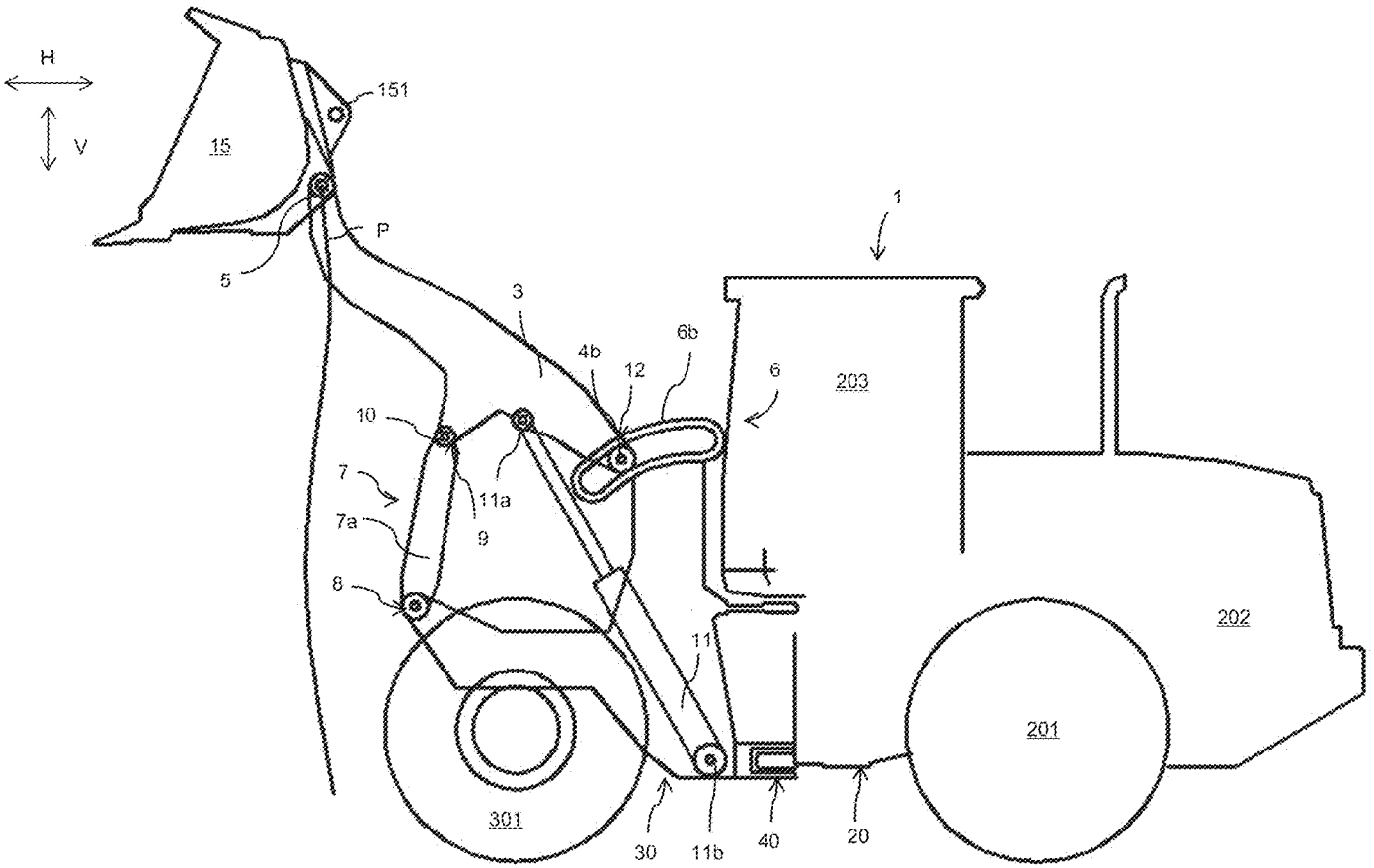
FIG. 12 illustrates a construction machine equipped with the lifting arrangement according to the fourth embodiment in a lifted position.

A fourth embodiment of the present invention is explained based on FIGS. 10-12. In the following, only differences between the first embodiment and the present fourth embodiment will be addressed. All remaining structures are basically the same as explained for the first embodiment.

While the previous embodiments employed a main arm support means 6 which includes main arm support link 6*a* the present fourth embodiment employs a sliding element 6*b* in the main arm support means 6. As shown in FIG. 10, a sliding element 6*b* is provided in the form of one or multiple guiding rails having a predetermined shape. In the present embodiment, the shape is a sector of a circle for providing a movement path of the pivot connector 4 of the main arm along a circular path. The pivot connector 4*b* of the main arm in the present embodiment is slightly modified in order to provide a sliding function in or on said sliding element 6*b*. Optional, a sliding piece or a roller arrangement can be used for providing the relative movement between the pivot connector 4*b* and the sliding element 6*b*.

The lifting operation of the present fourth embodiment is similar as the lifting operation of the first embodiment. The intermediate position of the lifting arrangement according to the fourth embodiment as shown in FIG. 11, while the lifted position of the lifting arrangement according to the fourth embodiment is shown in FIG. 12. With the structure according to the present embodiment, the increase in loading capacity or enhancing the total efficiency as in the first embodiment are achieved. In addition, it is possible with the present fourth embodiment to provide the sliding element 6*b* with a predetermined shape or curve in order to optimize the movement pattern of the equipment connector 5 upon the lifting operation of the lifting arrangement. In particular, it is possible in modification to provide the sliding element 6*b* with straight rails which are substantially arranged along the longitudinal direction of the construction machine.

It is noted that the additional arrangement of the sliding element 6*b* provides the same advantages as explained above. Also, this arrangement is not strictly required for achieving the above object and advantages. It is also noted that the fourth embodiment can be combined with the third embodiment in order to provide the additional advantages of both alternatives which can be realized in the lifting arrangement.

Fifth Embodiment

Figure 13:
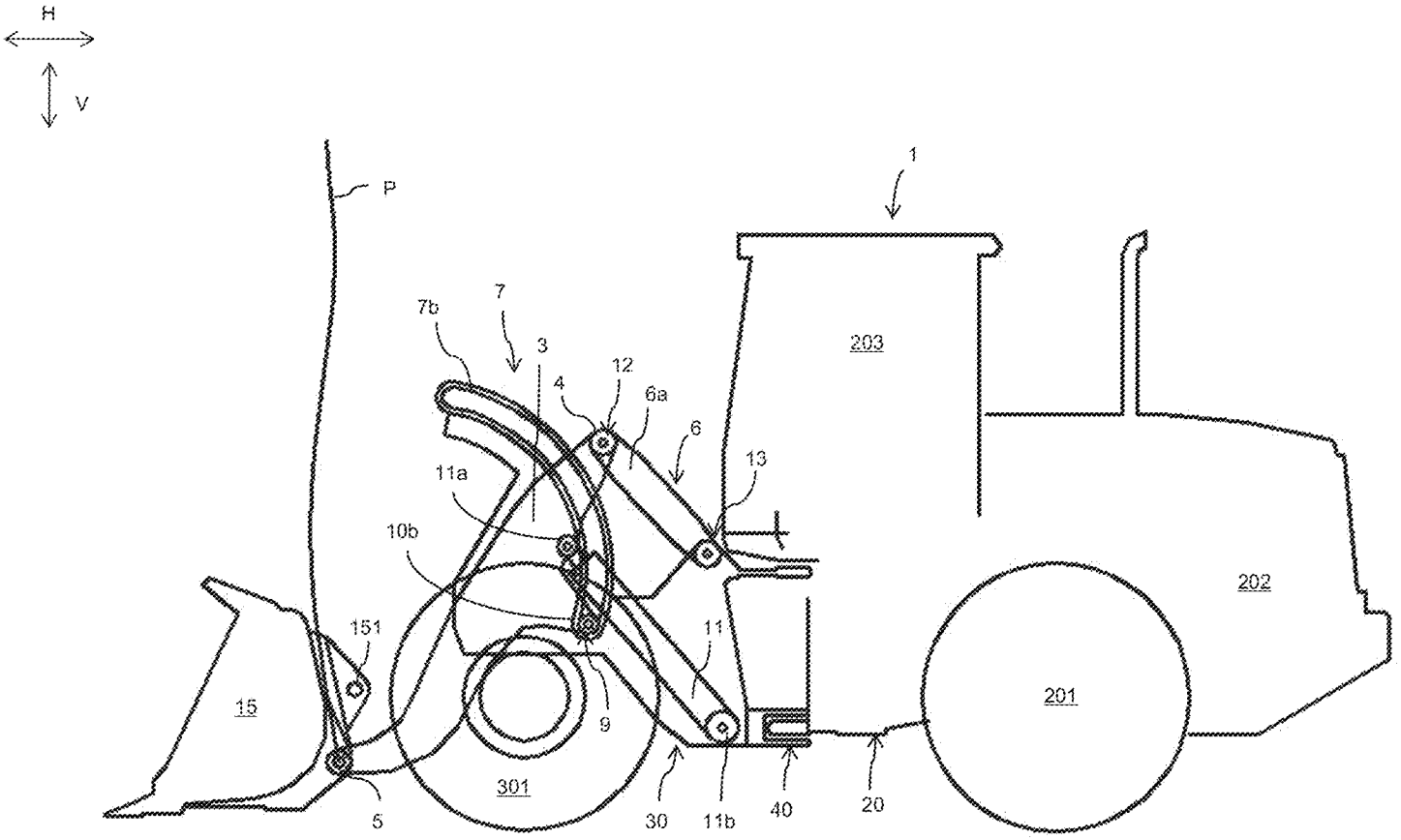
FIG. 13 illustrates a construction machine equipped with a lifting arrangement according to a fifth embodiment in a lowered position.
Figure 14:
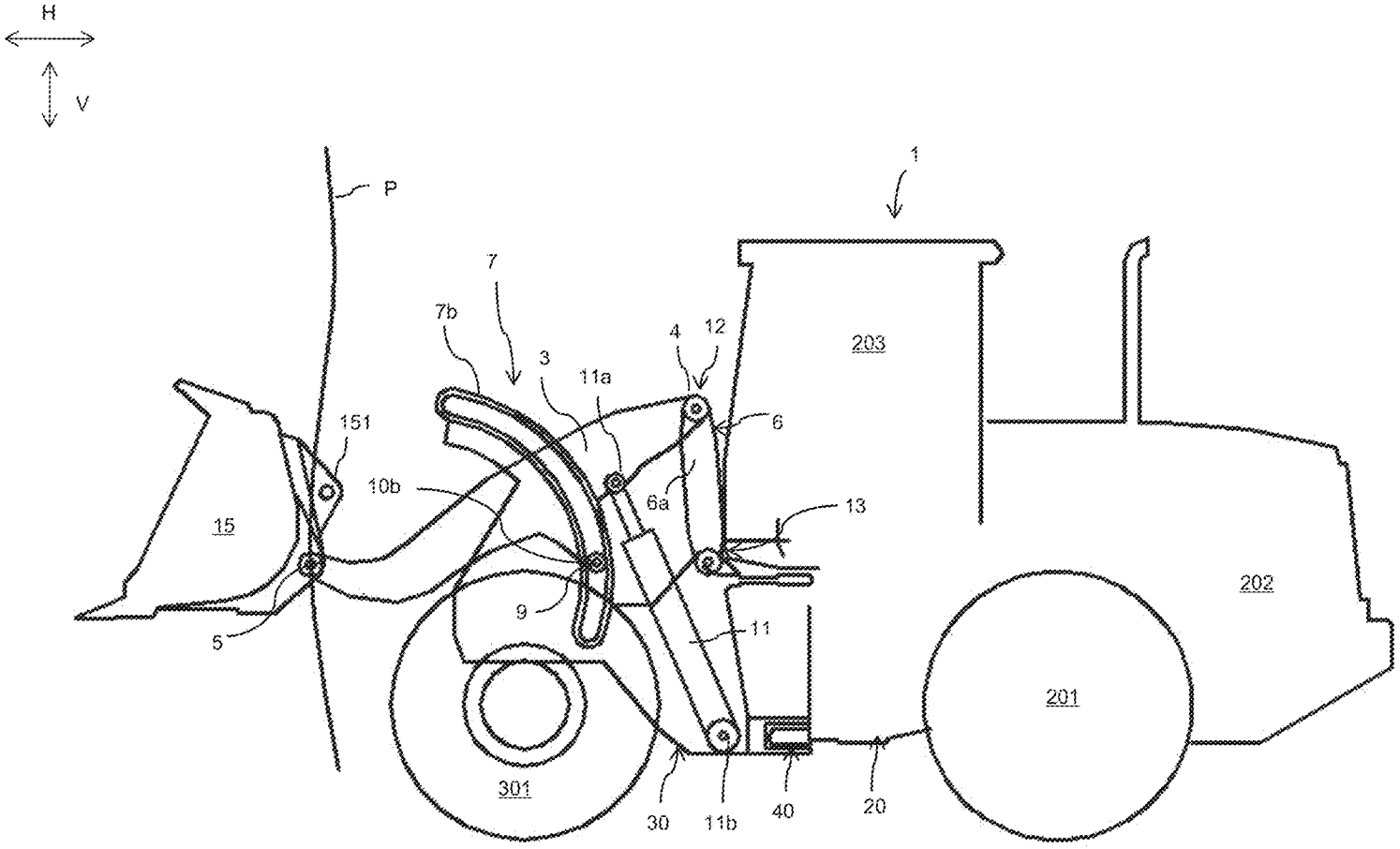
FIG. 14 illustrates a construction machine equipped with the lifting arrangement according to the fifth embodiment in an intermediate position.
Figure 15:
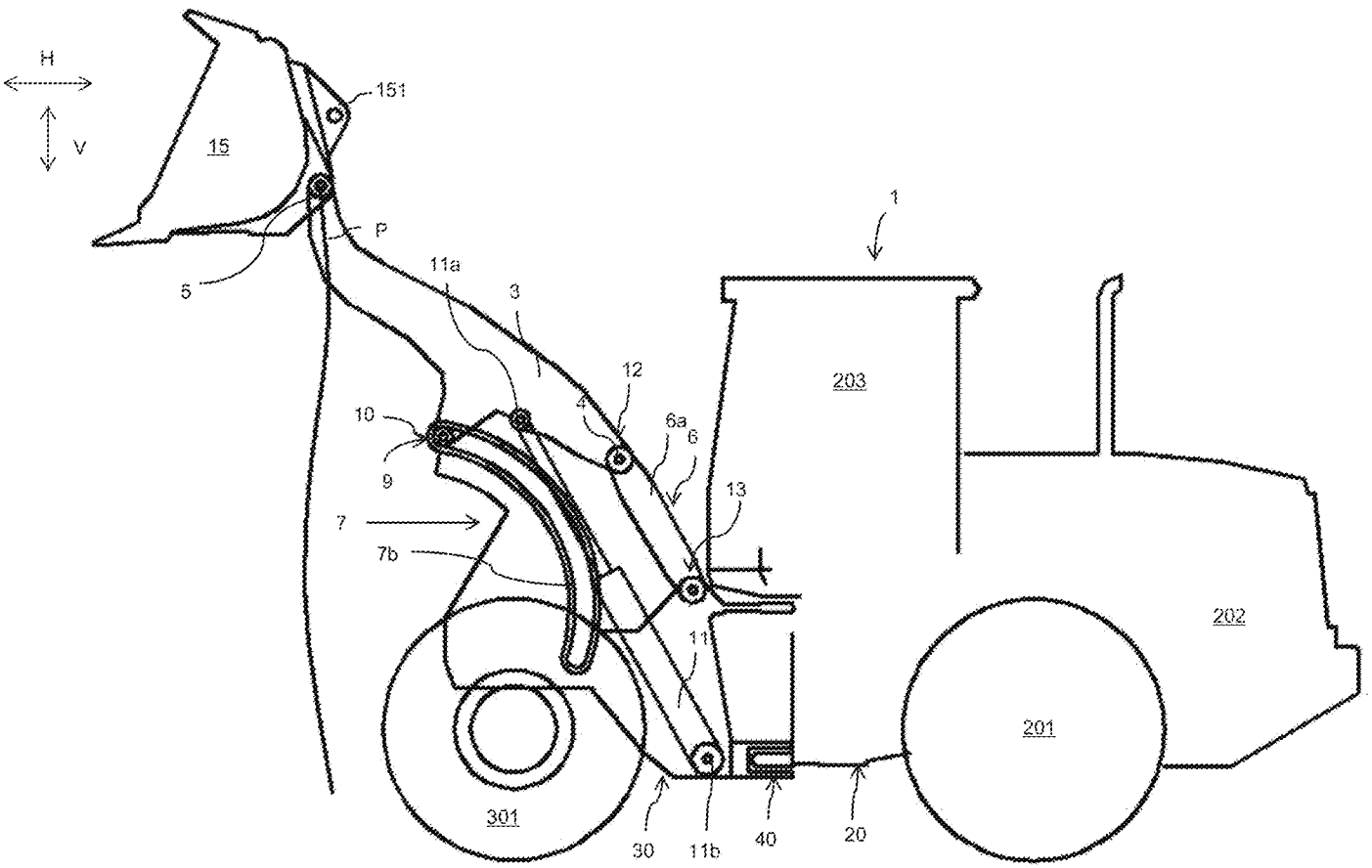
FIG. 15 illustrates a construction machine equipped with the lifting arrangement according to the fifth embodiment in a lifted position.

A fifth embodiment of the present invention is explained based on FIGS. 13-15. In the following, only differences between the first embodiment and the present fifth embodiment will be addressed. All remaining structures are basically the same as explained for the first embodiment.

While in the first embodiment, the guiding means 7 includes the guiding arm 7*a*, the guiding means 7 in the present fifth embodiment includes a guiding rail 7*b* which is mounted stationary with respect to the front frame portion 30. The guiding rail 7*b* in the embodiment shown in FIG. 13 is formed as sector of a circle. The guiding rail 7*b* is provided for guiding the guided portion 10 of the main arm 3. The guiding is achieved e.g. by a sliding piece or a roller arrangement for guiding the guided portion 10 of the main arm 3 along the guiding rail 7*b*. In the embodiment shown in FIG. 13, the shape of the guiding rail is such as the path along which the guided portion 10 is guided is bulged towards the rear side of the construction machine, e.g in the direction of the main arm support means 6.

The operation of the fifth embodiment is similar to the operation of the first embodiment. Starting from the lowered position shown in FIG. 13, the main arm is lifted by actuating the actuator 11 to the intermediate position shown in FIG. 14. Furthermore, the lifted position is achieved which is shown in FIG. 15 upon further actuating the actuator 11. By guiding the guided portion 10 of the main arm 3 along the path which is determined by the shape of the guiding rail 7*b*, the kinematic pattern is achieved which is similar to the kinematic pattern achieved with the first embodiment.

In particular, the same advantages regarding an increase of the loading capacity and the total efficiency of the construction machine are achieved with the fifth embodiment.

Although the guiding rail 7*b* according to the present fifth embodiment is shown as sector of a circle, it is possible to provide a different shape which deviates from the illustrated sector of a circle. In particular, it is possible to adapt the shape in order to optimize the kinematic pattern in view of achieving an optimum path P along which the equipment connector is to follow. As consequence, based on this degree of freedom, the path P can be further optimized by setting the shape of the guiding rail 7*b* according to the fifth embodiment.

It is noted that the additional arrangement of the actuator function of the guiding rail 7*b* provides the same advantages as explained above. Also, this arrangement is not strictly required for achieving the above object and advantages. It is also noted that the third embodiment can be combined with the second or fourth embodiment in order to provide the additional advantages of such alternatives which can be realized in the lifting arrangement.

Modifications

In the following, modifications of the above mentioned embodiments of the present invention are discussed based on FIGS. 16-27.

Figure 16:
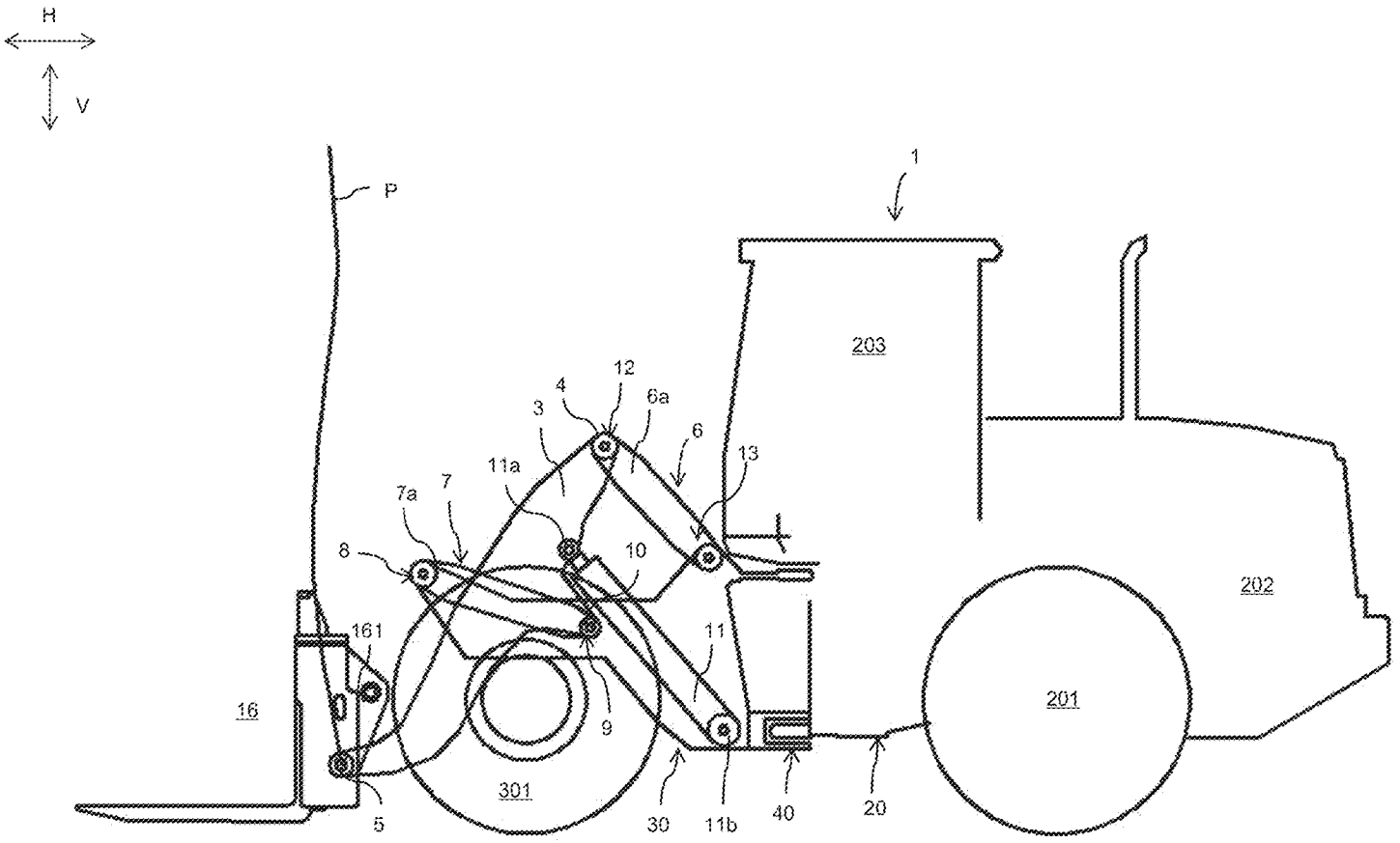
FIGS. 16-18 illustrate a construction machine equipped with a lifting arrangement according to a modification of the first embodiment.
Figure 17:
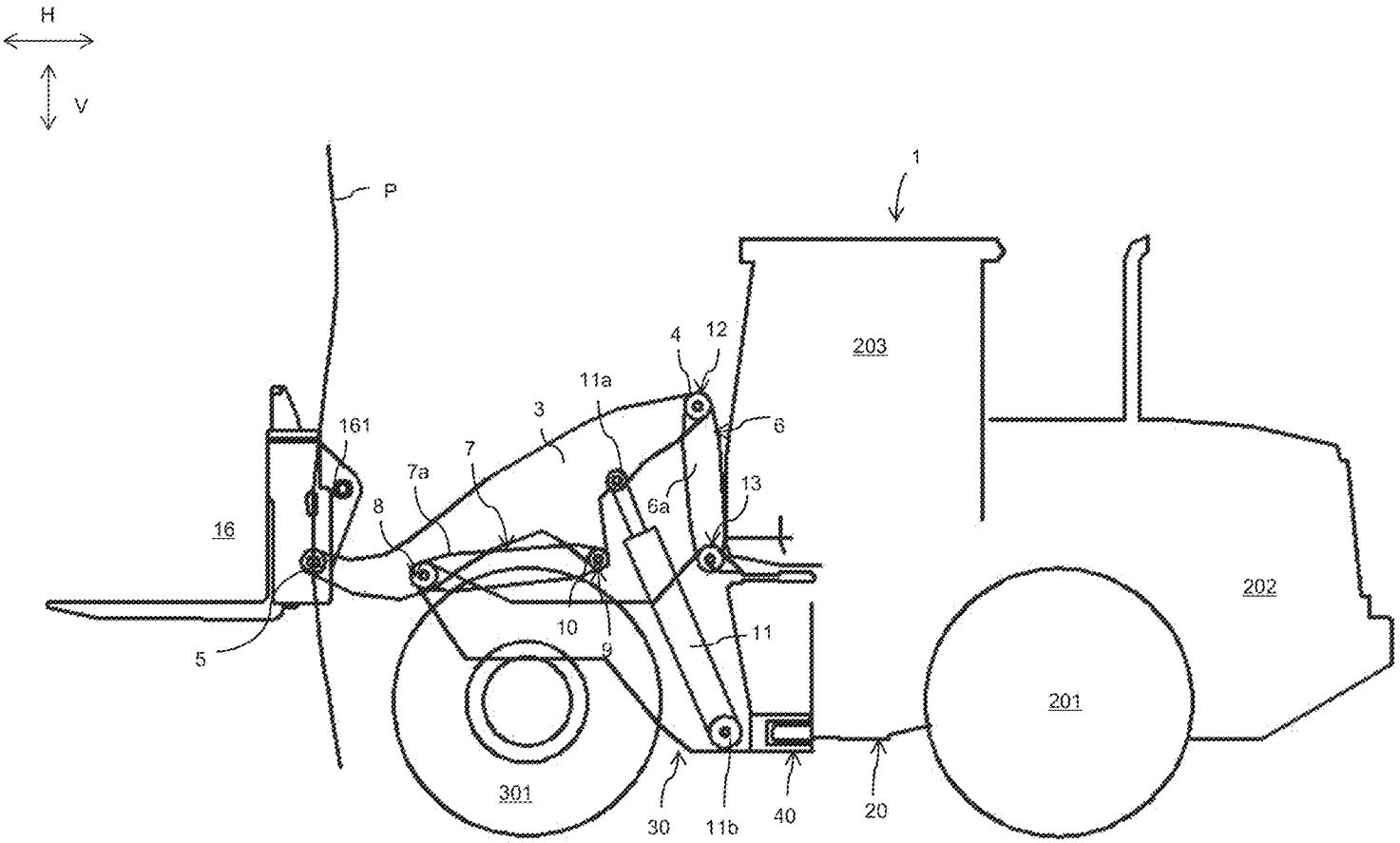
Figure 18:
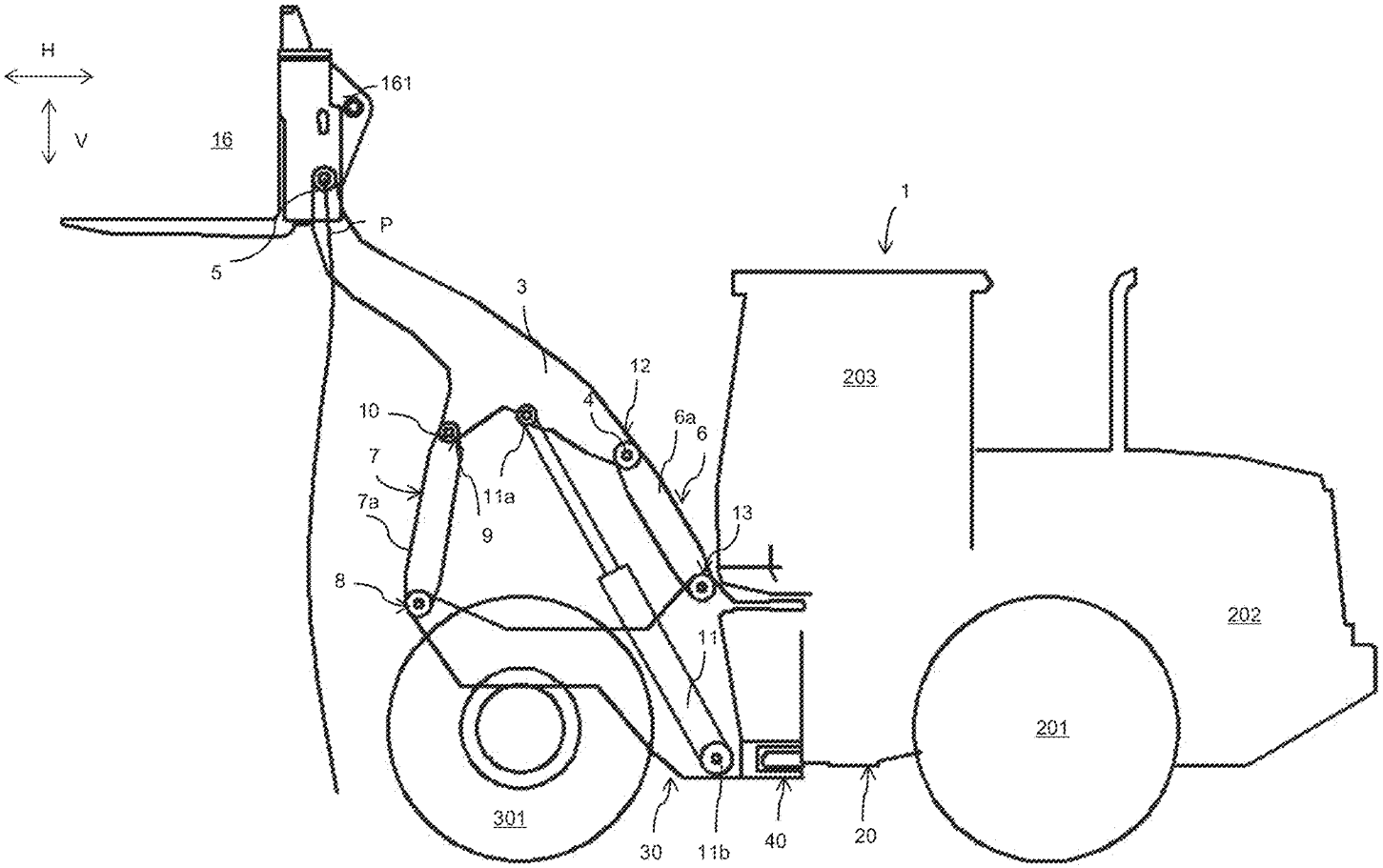
Figure 19:
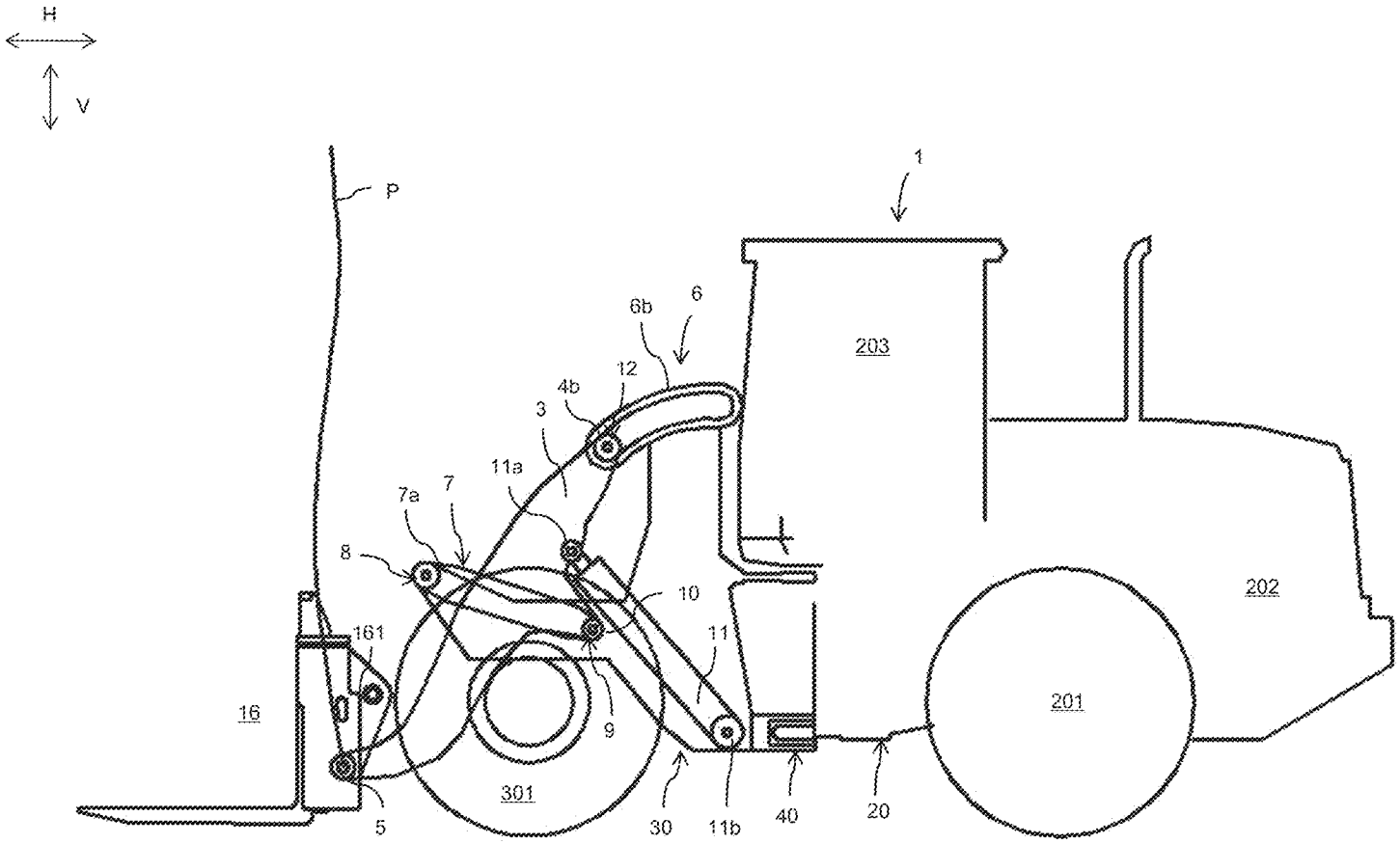
FIGS. 19-21 illustrate a construction machine equipped with a lifting arrangement according to a modification of the fourth embodiment.
Figure 20:
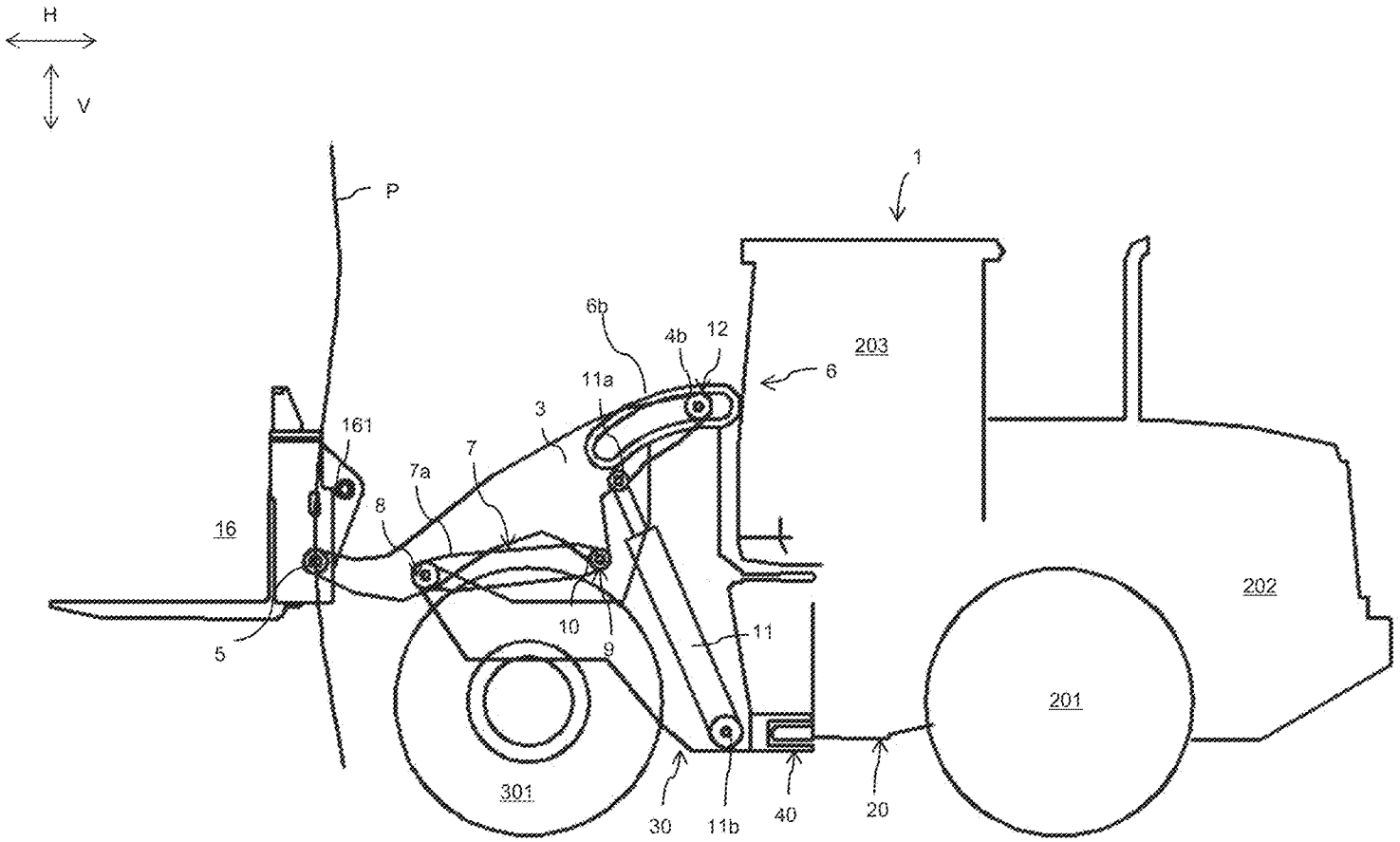
Figure 21:
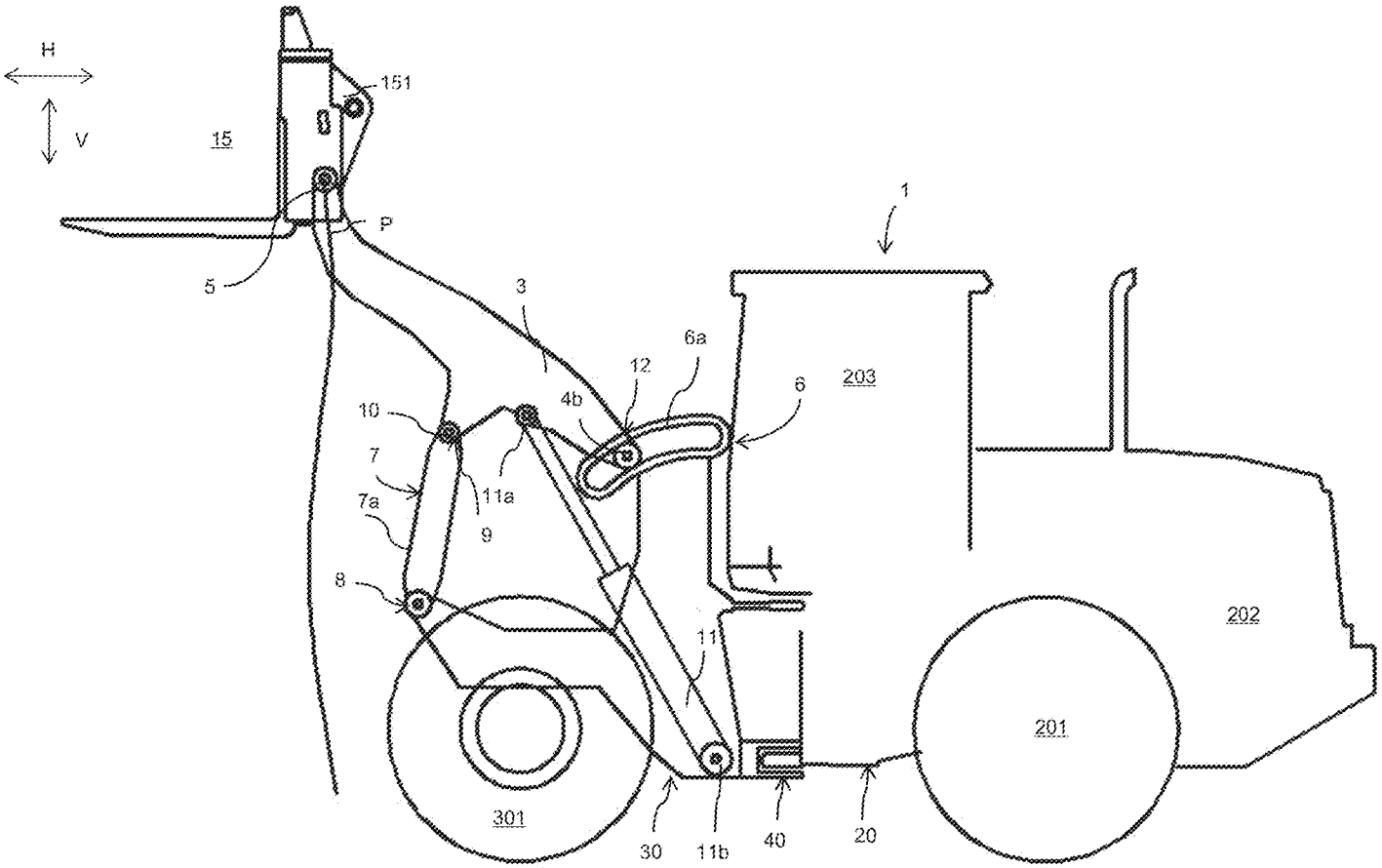
Figure 22:
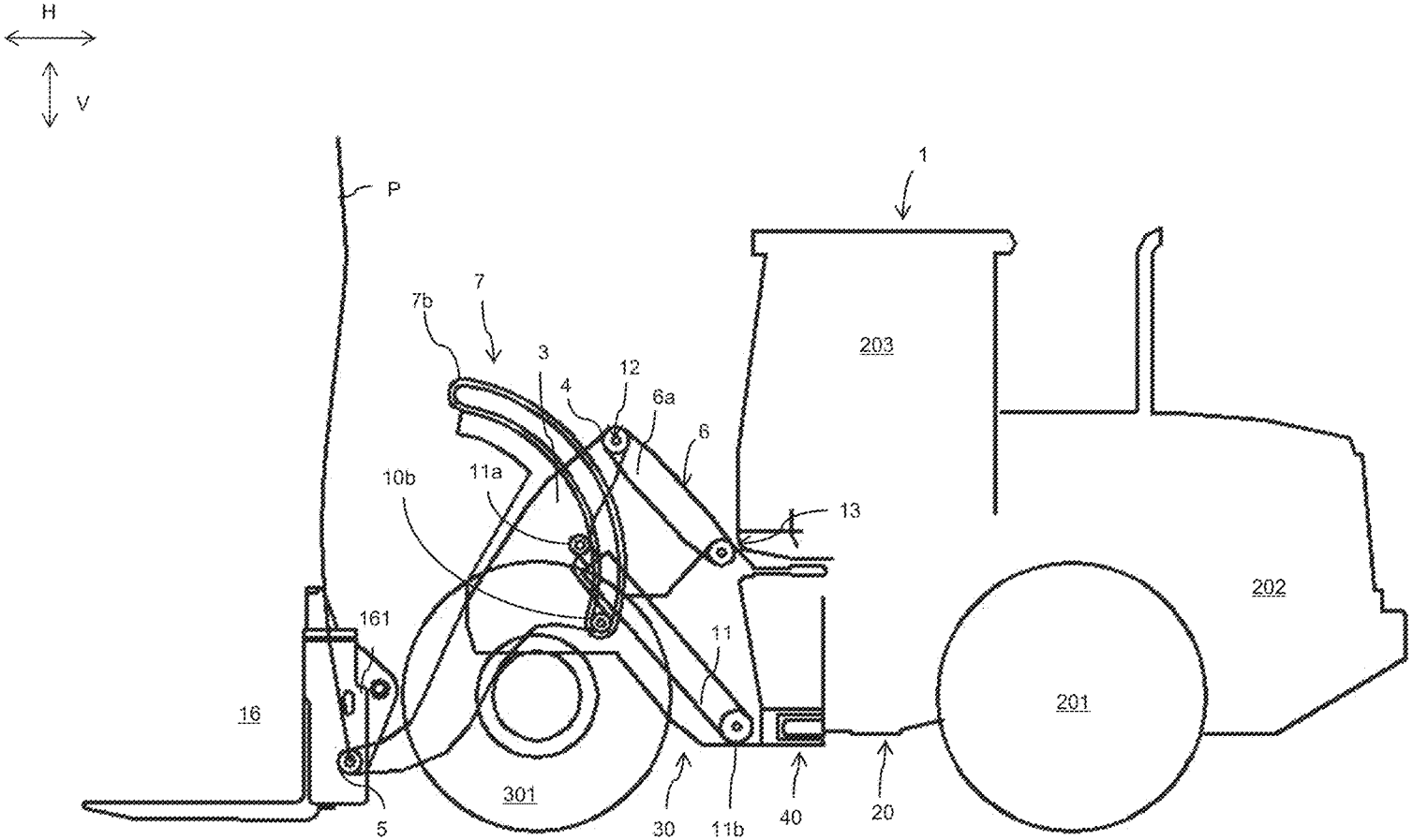
FIGS. 22-24 illustrate a construction machine equipped with a lifting arrangement according to a modification of the fifth embodiment.
Figure 23:
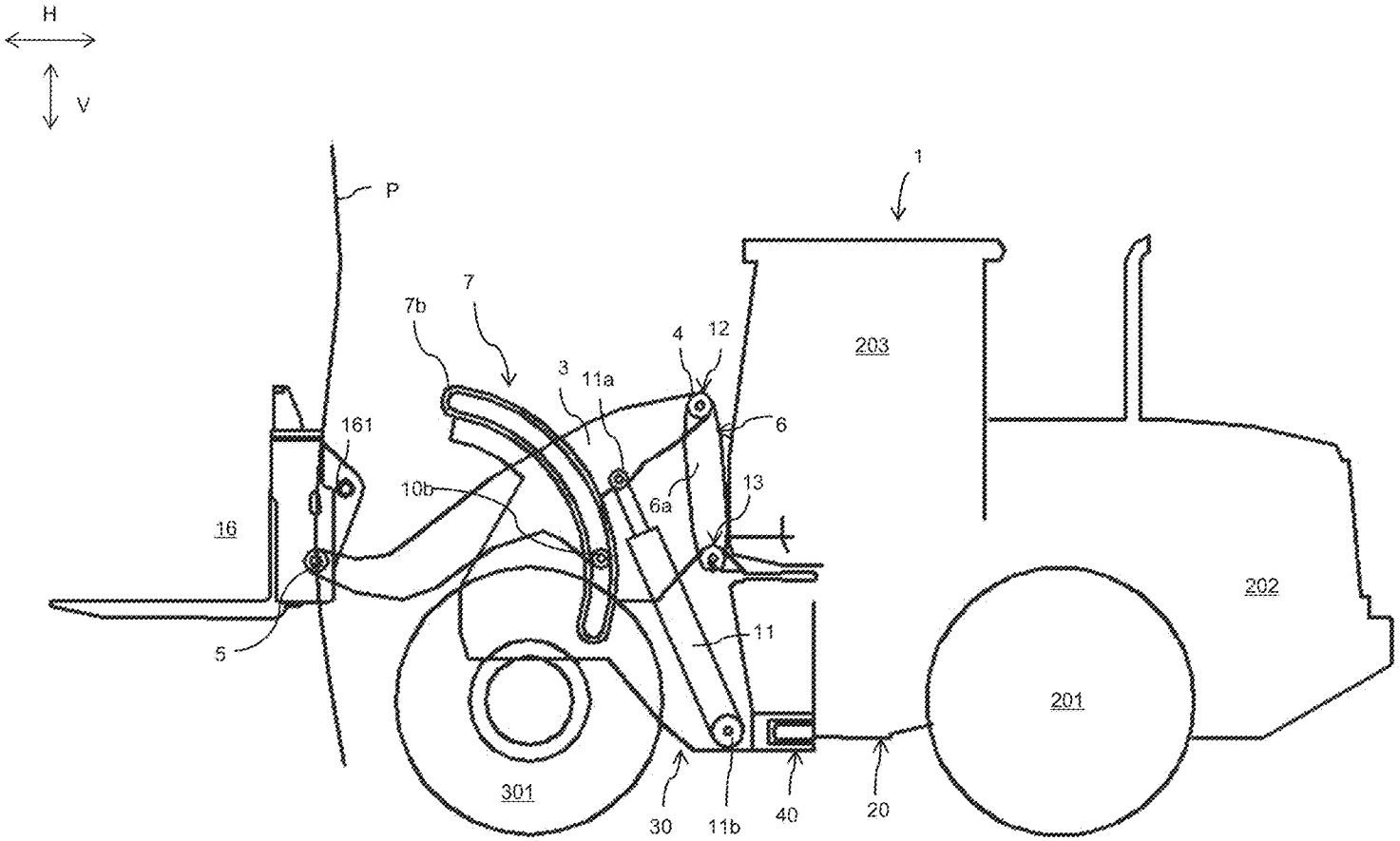
Figure 24:
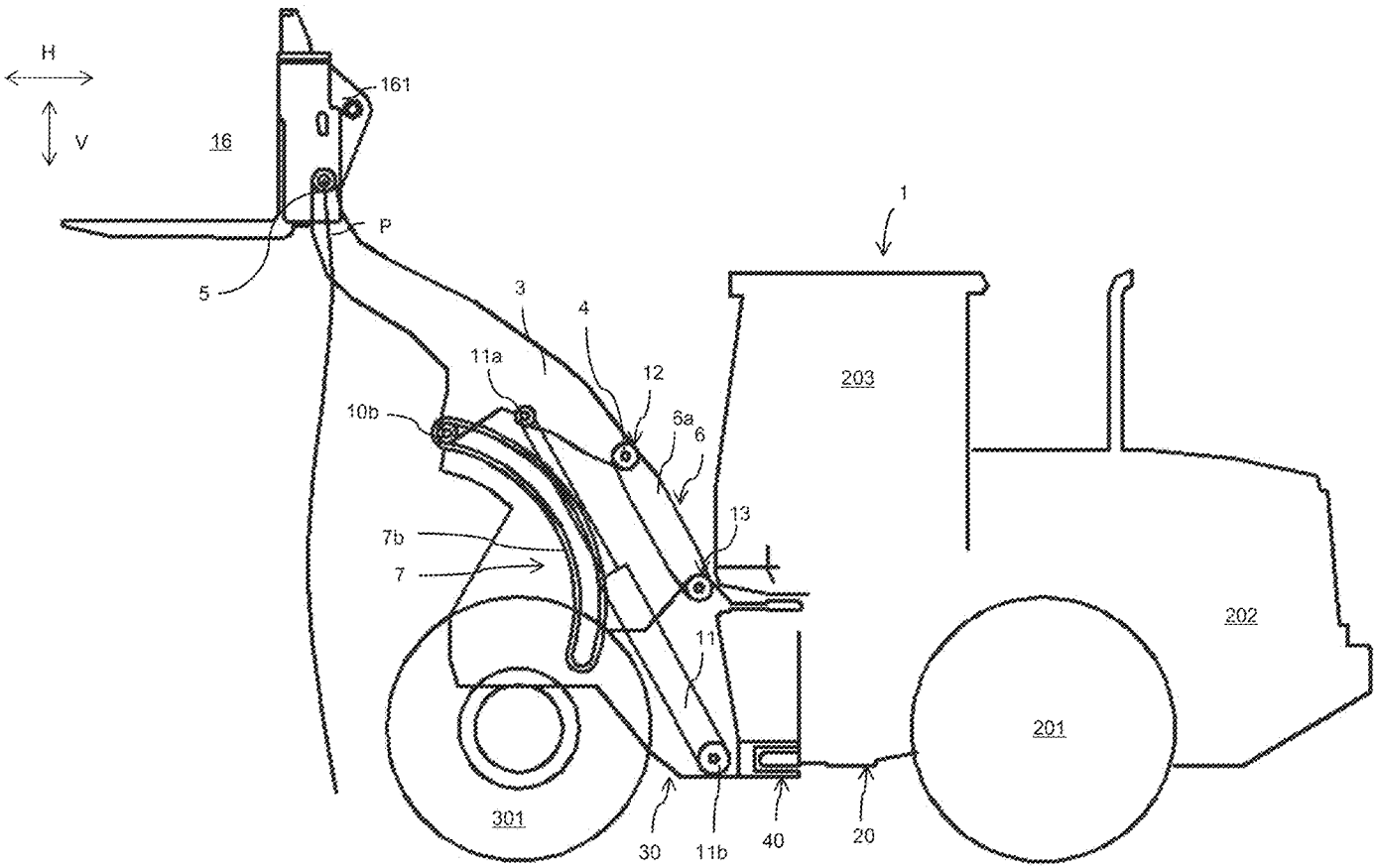

While a bucket 15 as equipment mounted to the equipment connector 5 is shown in the previous embodiments, it is possible to provide a lifting fork 16 as equipment to be mounted to the equipment connector 5. The above mentioned modification is applicable to all above mentioned embodiments. In particular, FIGS. 16-18 show this modification applicable to the first embodiment, FIGS. 19-21 show this modification applicable to the fourth embodiment, while FIGS. 22-24 show this modification applicable to the fifth embodiment.

Figure 25:
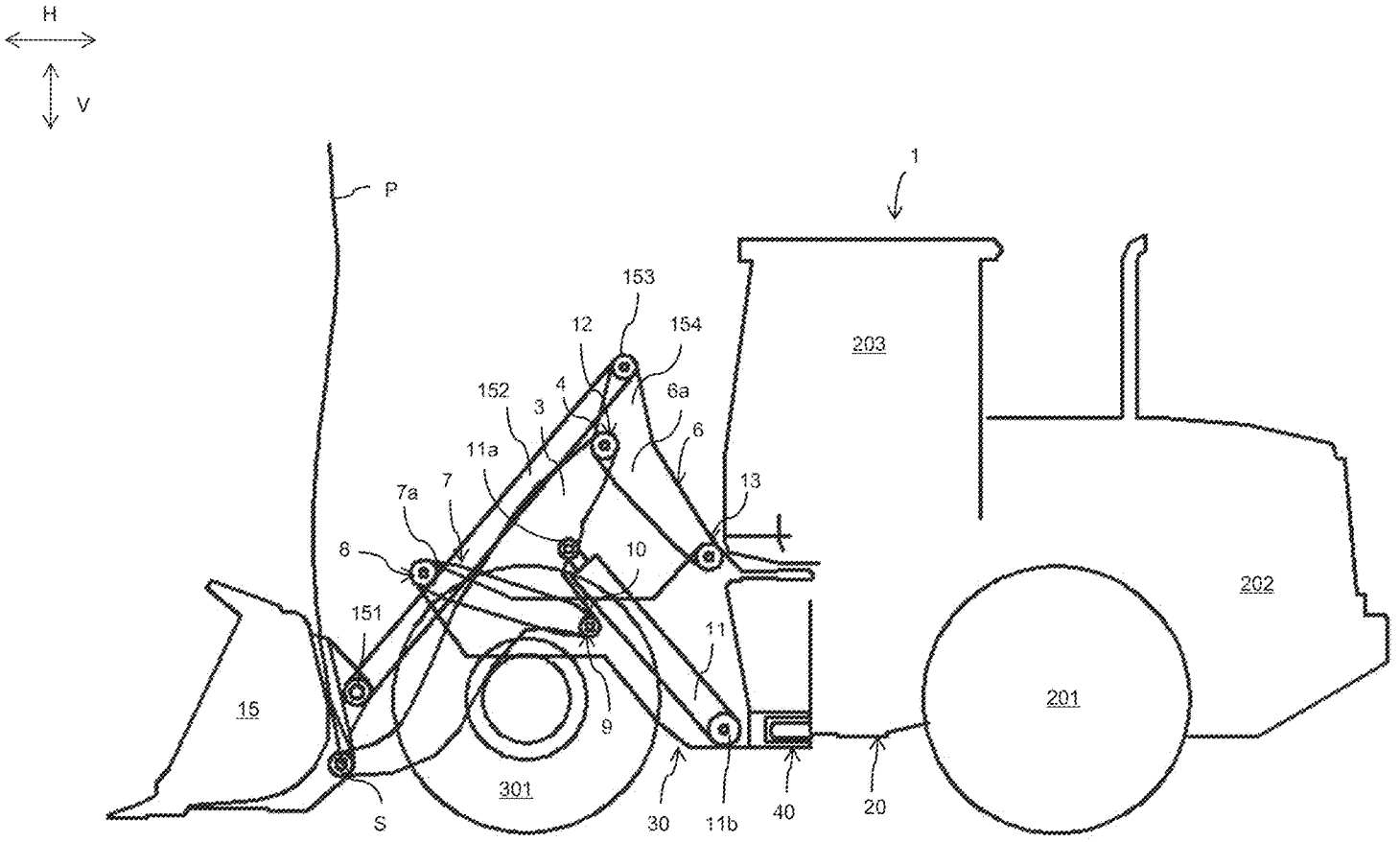
FIG. 25 illustrates a construction machine equipped with a lifting arrangement according to a sixth embodiment in a lowered position.
Figure 26:
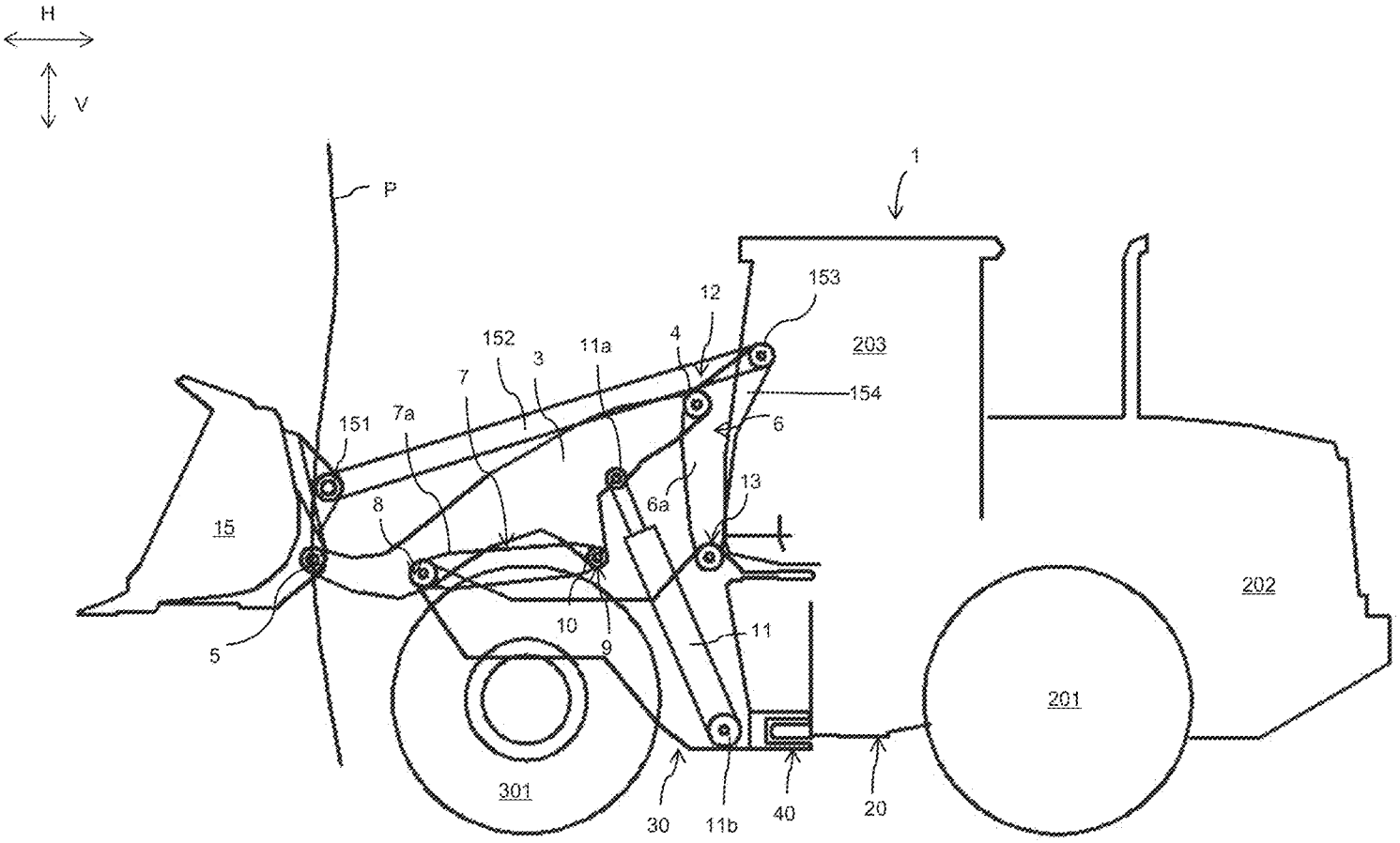
FIG. 26 illustrates a construction machine equipped with the lifting arrangement according to the sixth embodiment in an intermediate position.
Figure 27:
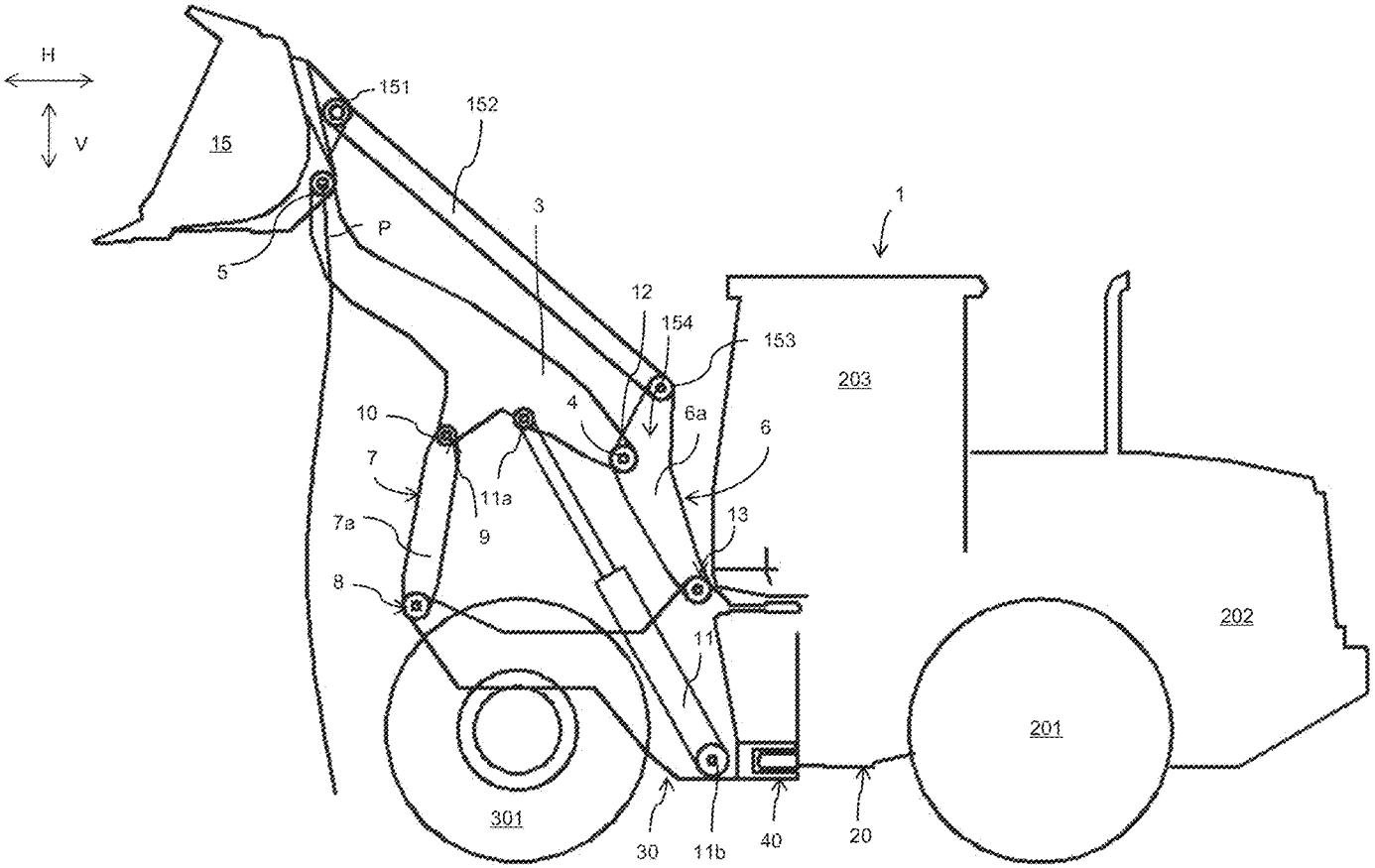
FIG. 27 illustrates a construction machine equipped with the lifting arrangement according to the sixth embodiment in a lifted position.

A further modification of the above mentioned embodiments which is also applicable to the above modifications is exemplary illustrated in FIGS. 25-27. As discussed above, the tilting arrangement for providing a tilting operation of the equipment, such as the bucket 15, is not illustrated in the drawings. FIG. 25 shows such an arrangement having a link mechanism 152 mounted to the tilt connector 151. The other end of the link mechanism 152 is mounted to an extension 154 via a bearing 153 provided at an element of the main arm support means 6 in the present case, at the main arm support link 6*a*. Based on such an arrangement, the tilt position of the equipment, such as the bucket 15 shown in FIG. 25, can be maintained constant throughout the lifting operation of the lifting arrangement shown in the sequence of FIGS. 25-27. While the lifting arrangement is in the lowered position in the illustration of FIG. 25, the position is in the intermediate position in FIG. 26 and reaches the maximum lift position in FIG. 27. As can be seen, the link mechanism 152 provides a constant tilt position of the equipment such as the bucket 15 shown in this example.

In addition, an actuating system can be provided for changing the tilt angle of the equipment which is not shown in the drawings. The link mechanism 152 can include or replaced by an actuator extending between the tilt connector 151 and the above mentioned bearing 153 of the main arm support element 6 in order to change the extension length between above mentioned elements. This actuator can be provided as linear actuator which is e.g. operated by hydraulic pressure in order to provide the tilting function of the bucket 15 or, as alternative, of the fork 16 or any other equipment mounted to the equipment connector 5.

The above modification relating to the tilt arrangement of the equipment is applicable to all above mentioned embodiment and it is clear that slight modifications will be implemented by the skilled person in order to adapt to the specific concepts discussed above.

It is noted that the above mentioned embodiments and modifications can be combined freely with each other in order to provide further advantages resulting from such a combination of features.

REFERENCE SIGNS

| | |
|---|---|
| 1 | construction machine |
| 3 | main arm |
| 4(4b) | pivot connector |
| 5 | equipment connector |
| 6 | main arm support means |
| 6a | main arm support link |
| 6b | sliding element |
| 6c | main arm support actuator |
| 7 | guiding means |
| 7a | guiding arm |
| 7b | guiding rail |
| 8 | first end |
| 9 | second end |
| 10 | guided portion |
| 11 | actuator |
| 11a | second end |
| 11b | first end |
| 12 | first end |
| 13 | second end |
| 15 | bucket |
| 16 | lifting fork |
| 20 | rear frame portion |
| 30 | front frame portion |
| 40 | articulating steering arrangement |
| 151 | tilt connector |
| 201 | a pair of rear wheels |
| 202 | engine compartment |
| 203 | operator's cap |
| 301 | a pair of front wheels |
| P | path |
| T | tilting point |
| H | horizontal direction |
| V | vertical direction |

The invention claimed is:

1. A loader, comprising:

an articulating frame arrangement comprising a front frame portion and a rear frame portion, the front and rear frame portions being articulatingly coupled to provide articulating steering, and a lifting arrangement comprising:

a main arm with a pivot connector at a proximate end thereof and an equipment connector at a distal end thereof, a main arm support means configured and arranged to pivotably support said pivot connector of said main arm, wherein said main arm support means is configured and arranged to be movable in a direction which includes at least a component in the front-rear direction with respect to said loader, an actuator engaged to the main arm between said pivot connector and a guided portion and configured and arranged to pivot said main arm about said pivot connector such that said equipment connector is movable between a lowered position and a lifted position, and a guiding means engaged to said main arm at said guided portion of said main arm positioned between said pivot connector and said equipment connector, wherein upon pivoting said main arm between said lowered position and said lifted position, said guided portion is configured and arranged to be guided by said guiding means along a curved path, wherein upon pivoting said main arm between said lowered position and said lifted position, said equipment connector follows a substantially vertical path, wherein said substantially vertical path is not a circular path, wherein elements forming said lifting arrangement are supported by said front frame portion of said articulating frame arrangement and are configured and arranged to be articulated together with said front frame portion with respect to said rear frame portion upon steering actions, and wherein at said lowered position of said equipment connector, said main arm support means is directed in an upwards direction toward said pivot connector.

2. A loader according to claim 1, configured and arranged so that by guiding said guided portion along said curved path upon pivoting said main arm between said lowered position and said lifted position, said main arm support means is forcedly moved in a direction which includes at least a component in the front-rear direction with respect to said loader.

3. A loader according to claim 1, configured and arranged so that by guiding said guided portion along said curved path upon pivoting said main arm between said lowered position and said lifted position via an intermediate position, said main arm support means is forced in a rearward shifted position when said main arm passes said intermediate position, whereas said main arm support means is forced in a forward shifted position when said main arm approaches said lowered position or said lifted position.

4. A loader according to claim 1, configured and arranged so that a path of said equipment connector upon pivoting said main arm between said lowered position and said lifted position deviates from a circular path determined by a radius formed by an effective length of said main arm.

5. A loader according to claim 1, wherein said main arm support means includes a main arm support link having a first end and a second end, the first end being pivotably coupled to said pivot connector of said main arm and said second end being pivotably connected coupled to said front frame portion, said first end being configured and arranged to be movable in a direction which includes at least a component in the front-rear direction with respect to said loader.

6. A loader according to claim 1, wherein said guiding means includes a guiding arm having a first end and a second end, the first end being pivotably mountable to said front frame portion and said second end being pivotably mounted to said main arm at said guided portion said main arm positioned between said pivot connector and said equipment connector.

7. A loader according to claim 6, configured and arranged so that upon pivoting said main arm between said lowered position and said lifted position, the rotational direction of the pivoting movement of said main arm is opposite to the rotational direction of the pivoting movement of said guiding arm.

8. A loader according to claim 1, wherein at least one of a bucket and a lifting fork are configured and arranged to lift heavy loads and are tiltably mounted to said equipment connector.

9. A loader according to claim 1, wherein the loader is a wheel.

10. A loader, comprising:

an articulating frame arrangement comprising a front frame portion and a rear frame portion, the front and rear frame portions being articulatingly coupled to provide articulating steering, and a lifting arrangement comprising:

a main arm with a pivot connector at a proximate end thereof and an equipment connector at a distal end thereof, a main arm support means configured and arranged to pivotably support the pivot connector of the main arm, a guiding means engaged to the main arm at a guided portion of the main arm positioned between the pivot connector and the equipment connector, and an actuator engaged to the main arm between the pivot connector and the guided portion and configured and arranged to pivot the main arm about the pivot connector such that the equipment connector is movable between a lowered position and a lifted position, wherein the main arm support means is directed in an upwards direction towards the pivot connector when the equipment connector is in the lowered position, wherein the main arm support means is movable in a direction which includes at least a component in the front-rear direction with respect to the loader, wherein upon pivoting the main arm between the lowered position and the lifted position, the guided portion is configured and arranged to be guided by the guiding means along a curved path, wherein upon pivoting the main arm between the lowered position and the lifted position, the equipment connector follows a substantially vertical path, wherein the substantially vertical path is not a circular path, and wherein elements forming the lifting arrangement are supported by the front frame portion of the articulating frame arrangement and are configured and arranged to be articulated together with the front frame portion with respect to the rear frame portion upon steering actions.

11. A loader according to claim 10, configured and arranged so that by guiding the guided portion along the curved path upon pivoting the main arm between the lowered position and the lifted position, the main arm support means is forcedly moved in a direction which includes at least a component in the front-rear direction with respect to the loader.

12. A loader according to claim 10, configured and arranged so that by guiding the guided portion along the curved path upon pivoting the main arm between the lowered position and the lifted position via an intermediate position, the main arm support means is forced in a rearward shifted position when the main arm passes the intermediate position, whereas the main arm support means is forced in a forward shifted position when the main arm approaches the lowered position or the lifted position.

13. A loader according to claim 10, configured and arranged so that a path of the equipment connector upon pivoting the main arm between the lowered position and the lifted position deviates from a circular path determined by a radius formed by an effective length of the main arm.

14. A loader according to claim 10, wherein the main arm support means includes a main arm support link having a first end and a second end, the first end being pivotably coupled to the pivot connector of the main arm and the second end being pivotably connected coupled to the front frame portion, the first end being configured and arranged to be movable in a direction which includes at least a component in the front-rear direction with respect to the loader.

15. A loader according to claim 10, wherein the guiding means includes a guiding arm having a first end and a second end, the first end being pivotably mountable to the front frame portion and the second end being pivotably mounted to the main arm at the guided portion the main arm positioned between the pivot connector and the equipment connector.

16. A loader according to claim 15, configured and arranged so that upon pivoting the main arm between the lowered position and the lifted position, the rotational direction of the pivoting movement of the main arm is opposite to the rotational direction of the pivoting movement of the guiding arm.

17. A loader according to claim 10, wherein at least one of a bucket and a lifting fork are configured and arranged to lift heavy loads and are tiltably mounted to the equipment connector.

18. A loader according to claim 10, wherein the loader is a wheel.

* * * * *